US007289895B2

(12) United States Patent
Ishimoto et al.

(10) Patent No.: US 7,289,895 B2
(45) Date of Patent: Oct. 30, 2007

(54) ELECTRONIC CONTROL SYSTEMS FOR CONSTRUCTION MACHINE

(75) Inventors: Hidefumi Ishimoto, Ibaraki-ken (JP); Yoshinori Eguchi, Tsuchiura (JP); Takao Kurosawa, Ibaraki-ken (JP); Hiroshi Ogura, Ryuugasaki (JP); Junichi Narisawa, Adachi-ku (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 197 days.

(21) Appl. No.: 10/476,250

(22) PCT Filed: Jan. 10, 2003

(86) PCT No.: PCT/JP03/00151

§ 371 (c)(1),
(2), (4) Date: Oct. 30, 2003

(87) PCT Pub. No.: WO03/060243

PCT Pub. Date: Jul. 24, 2003

(65) Prior Publication Data

US 2004/0133327 A1 Jul. 8, 2004

(30) Foreign Application Priority Data

Jan. 16, 2002 (JP) ..... 2002-007144

(51) Int. Cl.

| | |
|---|---|
| ***G06F 13/36*** | (2006.01) |
| ***H04J 3/22*** | (2006.01) |
| *H04J 3/16* | (2006.01) |
| *G06F 19/00* | (2006.01) |

(52) U.S. Cl. ..... 701/50; 701/36; 370/466; 710/306

(58) Field of Classification Search ..... 370/466, 370/467, 471; 340/425.1; 719/319; 710/315, 710/105; 701/50

See application file for complete search history.

(56) References Cited

U.S. PATENT DOCUMENTS

| | | | | |
|---|---|---|---|---|
| 6,189,057 | B1 * | 2/2001 | Schwanz et al. | 710/72 |
| 6,336,067 | B1 | 1/2002 | Watanabe et al. | |
| 6,349,252 | B1 * | 2/2002 | Imanishi et al. | 701/50 |
| 6,360,290 | B1 * | 3/2002 | Avritch et al. | 710/105 |

(Continued)

FOREIGN PATENT DOCUMENTS

| | | |
|---|---|---|
| EP | 1036887 | 9/2000 |

(Continued)

*Primary Examiner*—Thomas Black
*Assistant Examiner*—Christine M Behncke
(74) *Attorney, Agent, or Firm*—Mattingly, Stanger, Malur & Brundidge, P.C.

(57) ABSTRACT

In an electronic control system for a construction machine, a governor control unit, an excavator body control unit, and an electric lever control unit are interconnected for transmission and reception of data. A universal communication line is connected to the governor control unit and is adapted for an interface in conformity with universal communication standards A dedicated communication line is connected to the excavator body control unit and the electric lever control unit and is adapted for an interface in conformity with dedicated communication standards different from the univeral communication standards. A communication relay control unit is used for, converting and transmitting communication data received from one of two systems of the communication lines to be in conformity with the communication standards of the other communication line.

6 Claims, 35 Drawing Sheets

U.S. PATENT DOCUMENTS

| | | | | |
|---|---|---|---|---|
| 6,823,457 | B1 * | 11/2004 | Berstis et al. | 713/182 |
| 7,068,675 | B1 * | 6/2006 | Shitaya | 370/439 |
| 2002/0131451 | A1 * | 9/2002 | Franke et al. | 370/493 |
| 2003/0163587 | A1 * | 8/2003 | Knight et al. | 709/249 |

FOREIGN PATENT DOCUMENTS

| | | |
|---|---|---|
| JP | 8-28911 | 3/1996 |
| JP | 2000-54437 | 2/2000 |
| JP | 2000-73408 | 3/2000 |
| JP | 2000-297443 | 10/2000 |

* cited by examiner

FIG.8

| COMMUNICATION DATA NAME | | | CONTROL SYSTEM COMMUNICATION DATA | | | | MONITOR SYSTEM COMMUNICATION DATA | | | |
|---|---|---|---|---|---|---|---|---|---|---|
| ID No | DATA NAME | SYM-BOL | GOVERNOR CONTROL UNIT | EXCAVATOR BODY CONTROL UNIT | ELECTRIC LEVER CONTROL UNIT | COMMUNI-CATION CYCLE | EXCAVATOR BODY INFORMATION MONITOR | OPERATING INFOR-MATION MONITOR | GOVERNOR CONTROL UNIT | COMMUNI-CATION CYCLE |
| 101 | TARGET ENGINE REVOLUTION SPEED | Nr | ○ (CONVERT) | ● | | 50mS | | | | |
| 102 | ENGINE REVOLUTION SPEED | Ne | ○ (CONVERT) | ● | | 20mS | ● | ● (CONVERT) | ○ | 100mS |
| 103 | ENGINE OIL PRESSURE | Poil | | | | | ● | ● (CONVERT) | ○ | 1S |
| 104 | COOLING WATER TEMPERATURE | Tw | | | | | ● | ● (CONVERT) | ○ | 1S |
| 201 | PUMP DELIVERY PRESSURE | Pd | | | | | | | | |
| 202 | PUMP TILTING ANGLE | θ | | | | | | | | |
| 301 | OPERATION SIGNAL | X1 | | ● | ○ | 10mS | | | | |
| 302 | OPERATION SIGNAL | X2 | | ● | ○ | 10mS | | | | |
| 303 | OPERATION SIGNAL | X3 | | ● | ○ | 10mS | | | | |
| 401 | FILTER PRESSURE | Pflt | | | | | ○ | ● | | 1S |
| 402 | FUEL LEVEL | Fuel | | | | | ○ | ● | | 1S |

TRANSMIT : ○

RECEIVE : ●

FIG.24

EEPROM

ENGINE OPERATION RECORD

'2000.1.27 AM08:01 START
'2000.1.27 AM11:59 STOP
'2000.1.28 AM09:10 START
'2000.1.28 PM04:30 STOP
.
.
.

ACCUMULATED ENGINE OPERATION RECORD

1250hr

ENGINE OIL PRESSURE ABNORMALITY

'2000.1.27 AM10:00 ON
'2000.1.27 AM10:05 OFF

FILTER PRESSURE ABNORMALITY

'2000.1.28 AM11:00 ON
'2000.1.28 PM01:20 OFF

FUEL REMAINING AMOUNT WARNING

'2000.1.28 AM10:00 ON
'2000.1.28 AM11:00 OFF

FREQUENCY DISTRIBUTION OF WATER TEMPERATURE $Tw \geqq Tmax$ : 10hr
$Tmax > Tw \geqq T2$ : 190hr
$T2 > Tw \geqq T1$ : 310hr
$T1 > Tw \geqq T0$ : 520hr
$T0 > Tw$ : 220hr

ELECTRONIC CONTROL SYSTEMS FOR CONSTRUCTION MACHINE

TECHNICAL FIELD

The present invention relates to an electronic control system for a construction machine, in which a plurality of control units for controlling a prime mover, hydraulic devices, etc. of the construction machine are interconnected via a common communication line to constitute a network and data is transmitted and received via the network.

BACKGROUND ART

Recently, there has been an increasing demand for an improvement of performance and more versatile applications of construction machines, and more advanced electronic control of a construction machine has been developed to cope with the demand. In such a situation, an electronic control system used for that purpose is required to execute high-speed processing and to employ a highly intelligent microcomputer as an essential. As a result, problems arise in that the production cost is increased and control units and wire harness are complicated with an increased number of input/output signals of the system.

With the view of overcoming those problems, it is proposed to distribute a controller for performing overall control of a construction machine by dividing control functions required in a construction machine, i.e., a control target, in units of function, providing a controller (control unit) for each of the divided function units, and connecting the control units to each other via a network. For example, JP,B 8-28911 discloses an electronic control system for a construction machine, in which a control unit, such as an engine control unit or a pump control unit, is provided for each piece of equipment and these control units are interconnected by a single multi-transmission serial communication circuit to constitute a network for two-way communication, and hence in which a system extension can easily be realized.

DISCLOSURE OF THE INVENTION

The prior art described above has problems as follows.

Generally, a prime mover (engine) mounted as a driving source in a construction machine and an engine control unit for controlling the engine are constituted in many cases by using components which are employed in ordinary automobiles (such as tracks), for the purposes of improving productivity and reducing the cost.

Meanwhile, in the automobile manufacturing industry, electronic control of automobiles has been progressed for a long time prior to the field of construction machines because of a similar demand, such as a performance improvement, to that mentioned above. Regarding engine control, for example, common communication standards SAE J1939 are specified as universal standards primarily aiming at failure diagnosis, and an engine control unit having an interface in conformity with the universal communication standards is used. Many of recent construction machines, therefore, are equipped with engines and engine control units having interfaces in conformity with the universal communication standards developed in the automobile industry.

When applying the above-mentioned prior art to those recent construction machines, because the prior art has a structure that, as described above, all the control units are connected to the single multi-transmission serial communication line for mutual communication, it is required that all other control units than the engine control unit also have interfaces in conformity with the universal communication standards as with the engine control unit.

However, such an application of the prior art causes disadvantages, by way of example, given below.

(1) Disadvantage Regarding Communication Data Identifier

Because the above-described universal communication standards have originally been specified for automobiles particularly aiming at failure diagnosis, various communication data identifiers are already preserved for dedicated assignment in anticipation of the use in automobiles. However, many of those communication data identifiers are useless in construction machines, and conversely those identifiers do not include ones necessary in construction machines. While the universal communication standards are designed to allow additional assignment of specific communication data to extra identifiers, the number of available extra identifiers is small because the number of data identifiers is definite and many of the data identifiers are already assigned. Accordingly, there is no sufficient room in a process of data communication for newly adding specific data required in construction machines.

(2) Disadvantage Regarding Communication Speed

As discussed in (1), the above-described universal communication standards have originally been specified for automobiles. On the other hand, a construction machine includes not only a traveling mechanism and a control system for the traveling mechanism, which are similar to those equipped in an automobile, but also, taking a hydraulic excavator as an example, additional mechanisms, such as a front device comprising a boom, an arm, a bucket, etc. and an upper swing structure, hydraulic driving systems for driving those mechanisms, and control systems for controlling the hydraulic driving systems. Thus, the construction machine must handle communication data in amount much more than that required for control of an automobile. In the case of employing the universal communication standards, therefore, the communication speed specified therein is not sufficient to communicate such a large amount of data in a satisfactory condition, and the communication rate is not enough for electronic control of the construction machine.

As will be seen from the above description of the disadvantages (1) and (2) as examples, the prior art cannot satisfactorily develop the function required for electronic control of the recent construction machine.

The present invention is intended to provide an electronic control system for a construction machine, which can develop a satisfactory electronic control function even in a recent construction machine having an interface in conformity with the universal communication standards.

To achieve the above object, the present invention provides an electronic control system for a construction machine, which is equipped in a construction machine comprising a prime mover, a plurality of working devices, and plural pieces of hydraulic equipment generating hydraulic power based on driving forces of the prime mover and driving the working devices, the electronic control system having a plurality of control units including at least one of a prime mover control unit for controlling the prime mover and hydraulic equipment control units for controlling the hydraulic equipment, the plurality of control units being interconnected for transmission and reception of data, the electronic control system further comprising a universal communication line connected to a particular one of the plurality of control units and adapted for an interface in conformity with universal communication standards; a dedicated communication line connected to other ones of the plurality of control units than the particular one and adapted for an interface in conformity with dedicated communication standards different from the universal communication standards; and a communication relay control unit connected to the universal communication line and the dedicated communication line, converting communication data received from one of two systems of the communication lines to be in conformity with the communication standards of the other communication line, and transmitting converted data to the other communication line.

With the present invention, the particular one of the plurality of control units, e.g., the prime mover control unit, is connected to the universal communication line adapted for the interface in conformity with the universal communication standards, while the other control units are connected to the dedicated communication line adapted for the interface in conformity with the dedicated communication standards different from the universal communication standards. Then, the communication relay control unit is provided for mutual data communication between those communication lines in conformity with the different communication standards, whereby communication data received from one of the two communication lines is transmitted after being converted to be in conformity with the communication standards of the other communication line.

Thus, because of employing two systems of communication lines, the side of the prime mover control unit can be constructed using the interface in conformity with the universal communication standards adopted in, for example, the automobile industry as conventional. On the other hand, the side of the dedicated communication line associated with the hydraulic equipment control units, etc. other than the prime mover control unit can be constructed in conformity with the specific dedicated communication standards without undergoing restrictions imposed from using the universal communication standards, whereby the contents of communication data, the communication cycle, etc., which are optimum for, e.g., control and collection of information of the construction machine, can be employed based on specific definition. As a result, a satisfactory electronic control function can be developed even when the present invention is applied to a recent construction machine having an interface in conformity with the universal communication standards.

Also, to achieve the above object, the present invention provides an electronic control system for a construction machine, which is equipped in a construction machine comprising a prime mover, a plurality of working devices, and plural pieces of hydraulic equipment generating hydraulic power based on driving forces of the prime mover and driving the working devices, the electronic control system having a plurality of control units including at least one of a prime mover control unit for controlling the prime mover and hydraulic equipment control units for controlling the hydraulic equipment, the plurality of control units being interconnected for transmission and reception of data, the electronic control system further comprising a universal communication line connected to a particular one of the plurality of control units and adapted for an interface in conformity with universal communication standards; a dedicated communication line connected to other ones of the plurality of control units than the particular one and adapted for an interface in conformity with dedicated communication standards different from the universal communication standards; and a communication management control unit connected to the universal communication line and the dedicated communication line, and comprising storage means for temporarily storing communication data received from two systems of the communication lines, and conversion means for, when a transmission request for communication data received from one of the two systems of the communication lines and stored in the storage means is received via the other communication line, converting the stored communication data to be adapted for the communication standards of the other communication line and outputting the converted data.

With those features, the communication management control unit is able to store all communication data from a plurality of control units and monitors, etc. together and to manage the data in a centralized manner. Accordingly, processing on the data transmitting side and processing on the data receiving side can be handled independently of each other through the communication management control unit. More specifically, the data transmitting side is just required to transmit data to the communication management control unit within the ordinary control cycle set for the data transmitting side itself. The data receiving side is just required to transmit a data transmission request to the communication management control unit within the ordinary control cycle set for the data receiving side itself and to receive data from the communication management control unit. As a result, the number of processing steps in each of the control units can be reduced. Also, the data transmitting side is no longer required, for example, to transmit data in response to an interrupt of a data transmission request from the data receiving side. It is therefore possible to prevent a reduction of the processing efficiency which is otherwise caused with the occurrence of the transmission request interrupt. Further, on the data receiving side, because a delay time from transmission of the data transmission request to actual sending of data can be cut down, and a reduction of the processing efficiency can be prevented which is otherwise caused with the necessity of waiting for arrival of the communication data. As a result, the communication processing load and the control processing load imposed on each of the control units and the monitors can be greatly reduced.

Preferably, the plurality of control units includes both of the prime mover control unit and the hydraulic equipment control units, the universal communication line is connected to the prime mover control unit, and the dedicated communication line is connected to the hydraulic equipment control units.

Preferably, the electronic control system for the construction machine further comprises at least one monitor connected to the dedicated communication line and monitoring operating status of the construction machine.

Preferably, the electronic control system for the construction machine further comprises a plurality of sensors for detecting status variables related to operating status of the construction machine, and at least one of the control units or the monitors includes collection means for collecting detected signals from the sensors.

In addition, preferably, the control units or the monitors for collecting the detected signals include information creating means for creating operating information data or failure information data for each of components of the construction machine based on the detected signals collected.

BRIEF DESCRIPTION OF THE DRAWINGS

FIG. 8 shows, in the form of a table, communication data via common communication lines in the first embodiment.

FIG. 24 shows a configuration of data recorded in an EEPROM in the main process of the operating information monitor.

BEST MODE FOR CARRYING OUT THE INVENTION

Embodiments of the present invention will be described below with reference to the drawings.

A first embodiment of the present invention will be described with reference to FIGS. 1 to 32.

Figure 1:
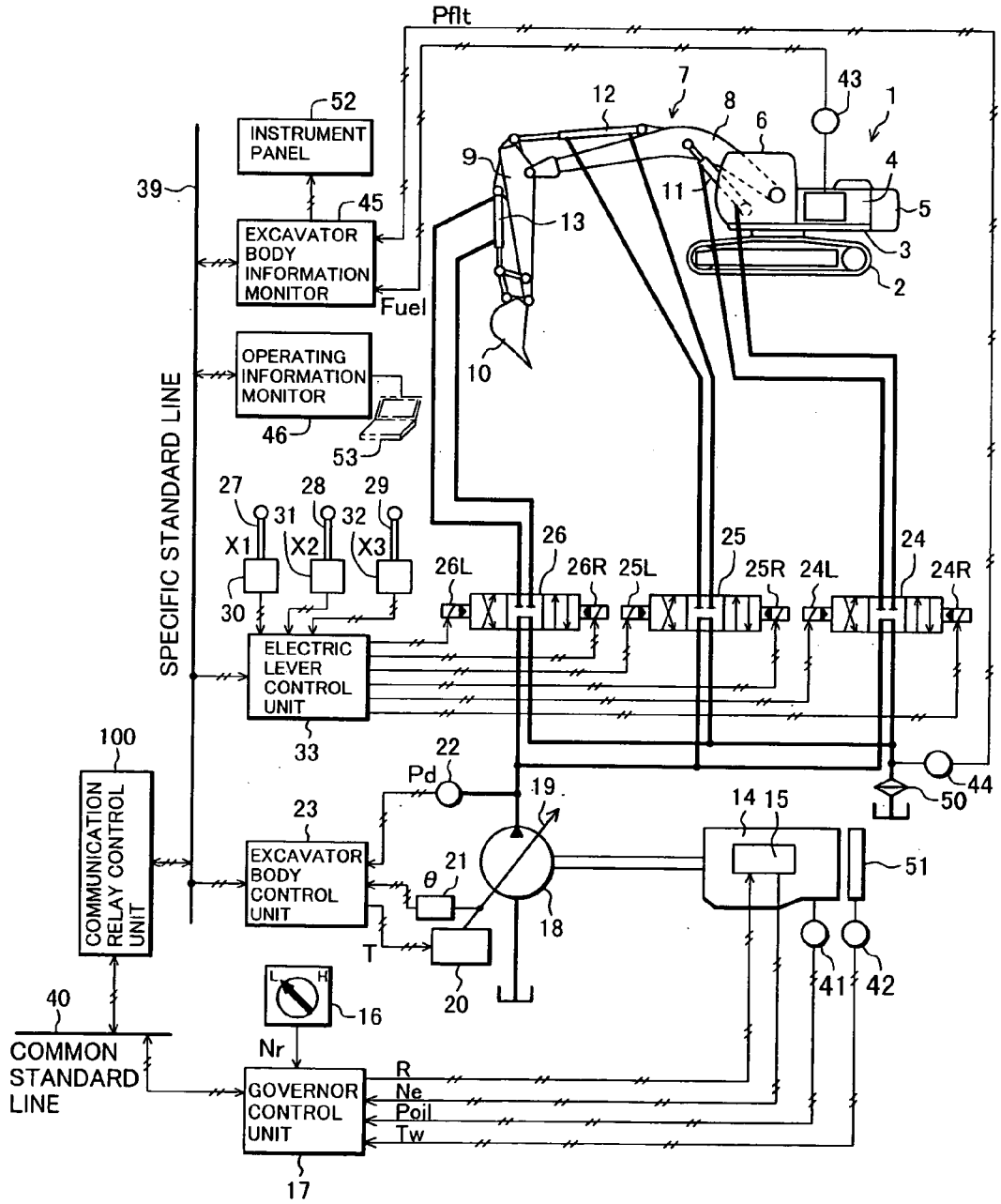
FIG. 1 is a block diagram of an electronic control system for a hydraulic excavator according to a first embodiment of the present invention, the diagram also illustrating the hydraulic excavator and a hydraulic system.

FIG. 1 is a block diagram of an electronic control system for a hydraulic excavator according to a first embodiment of the present invention, the diagram also illustrating the hydraulic excavator and a hydraulic system equipped in the hydraulic excavator. Referring to FIG. 1, numeral 1 denotes a hydraulic excavator. The hydraulic excavator 1 comprises a lower travel structure 2, an upper swing structure 3 swingably mounted on the lower travel structure 2, an accommodation room 4 formed in the upper swing structure 3 and accommodating a prime mover 14, a hydraulic pump 18, etc. therein, a counterweight 5 disposed in a rear portion of the upper swing structure 3, a cab 6 disposed on the front left side of the upper swing structure 3, and an excavation operating device 7 disposed at the center of the upper swing structure 3 in its front portion.

The excavation operating device 7 is made up of a boom 8 provided on the upper swing structure 3 in a vertically rotatable manner, an arm 9 rotatably provided at a fore end of the boom 8, a bucket 10 rotatably provided at a fore end of the arm 9, a boom operating hydraulic cylinder 11 for rotating the boom 8 in the vertical direction, an arm operating hydraulic cylinder 12 for rotating the arm 9, and a bucket operating hydraulic cylinder 13 for rotating the bucket 10.

The prime mover 14 is a diesel engine and includes an electronic governor 15 for holding the revolution speed of the prime mover within a certain range. A target revolution speed Nr of the prime mover (hereinafter referred to also as an "engine") 14 is set by a throttle dial 16. The governor 15 has the function of detecting an actual revolution speed of the engine 14.

The hydraulic pump 18 is driven for rotation by the engine 14. Also, the hydraulic pump 18 is a variable displacement pump and includes a swash plate 19 for changing the delivery rate of the hydraulic pump 18. A delivery rate adjusting device 20 is coupled to the swash plate 19. Further, there are provided a swash plate position sensor 21 for detecting a tilting angle of the swash plate 19 and a pressure sensor 22 for detecting a delivery pressure of the hydraulic pump 18.

The engine 14 is provided with a governor control unit 17. The governor control unit 17 receives various signals, i.e., the target revolution speed Nr set by the throttle dial 16 and the actual revolution speed Ne detected by the governor 15, executes a predetermined computation based on values of the input signals, and outputs a control signal R to the governor 15 so that the actual revolution speed Ne is matched with the target revolution speed Nr.

The hydraulic pump 18 is provided with an excavator body control unit 23. The excavator body control unit 23 receives various signals, i.e., the delivery pressure Pd of the hydraulic pump 18 detected by the pressure sensor 22 and the tilting angle θ of the swash plate 19 detected by the swash plate position sensor 21, executes a predetermined computation based on values of the input signals, and outputs a control signal T for the swash plate 19 to the delivery rate adjusting device 20 for the hydraulic pump 18.

The boom operating hydraulic cylinder 11, the arm operating hydraulic cylinder 12, and the bucket operating hydraulic cylinder 13 are connected to the hydraulic pump 18 through control valves 24, 25 and 26, respectively. The control valves 24, 25 and 26 adjust the flow rates and the directions of a hydraulic fluid supplied from the hydraulic pump 18 to the respective hydraulic cylinders 11, 12 and 13.

Control levers 27, 28 and 29 in the form of so-called electric levers are associated respectively with the control valves 24, 25 and 26. Lever signal generators 30, 31 and 32 are coupled respectively to the control levers 27, 28 and 29. The lever signal generators 30, 31 and 32 output, as operation signals X1, X2 and X3, electric signals depending on respective input amounts by which the control levers 27, 28 and 29 are operated.

The operation signals X1, X2 and X3 are inputted to an electric lever control unit 33. The electric lever control unit 33 executes predetermined processing based on the operation signals X1, X2 and X3, and outputs control signals to operating sectors 24L or 24R, 25L or 25R and 26L or 26R of the control valves 24, 25 and 26.

Also, the engine 14 is provided with an oil pressure sensor 41 for measuring a pressure of lubricating oil, and a water temperature sensor 42 mounted to a radiator 51 for cooling engine cooling water. Respective signals of an engine oil pressure (engine lubricant pressure) Poil and a cooling water temperature Tw detected by those sensors are inputted to the governor control unit 17 and are used for monitoring an abnormal condition of the engine 14.

Furthermore, the electronic control system of this embodiment includes other sensors for monitoring conditions of various devices of the hydraulic excavator 1. In this embodiment, there are provided a fuel level sensor 43 for measuring a remaining amount of fuel and a pressure sensor 44 disposed in a hydraulic circuit and detecting clogging of a filter 50. Respective signals of a fuel level Fuel and a filter pressure Pflt detected by those sensors are inputted to an excavator body information monitor 45. The excavator body information monitor 45 displays data of the input information on an instrument panel 52 equipped in the cab 6 with the aid of a meter, a warning lamp, etc.

Additionally, the electronic control system includes an operating information monitor 46 for storing an operating situation of the hydraulic excavator 1. The operating information monitor 46 receives respective signals outputted from the excavator body information monitor 45 and the governor control unit 17 via communication, executes processing of the input signals, and then time-serially or statistically measures and stores an operating time and an operating condition of the hydraulic excavator 1. When it is desired to collect the operating information data during maintenance, for example, an external device (external information terminal), such as a personal computer (PC) 53, is connected to the operating information monitor 46 so that the operating information data can be outputted to, e.g., the PC 53. In this respect, the operating information monitor 46 may have the function of determining the presence or absence of failures of the various sensors, the control units 17, 23, 33, or the monitors 45, 46 themselves, and may output not only the operating information data, but also failure information data to, e.g., the PC 53.

As the most important feature of this embodiment, the electronic control system includes two common buses for data communication, i.e., a specific standard communication line 39 connected to the excavator body control unit 23, the electric lever control unit 33, the excavator body information monitor 45, and the operating information monitor 46 for communication of control data and monitoring data among them, and a common standard communication line 40 connected to the governor control unit 17. Further, a communication relay control unit 100 is connected to both the communication lines 39 and 40 for the purpose of relay between them.

The governor control unit 17 has an interface in conformity with universal communication standards, e.g., common communication standards SAE J1939 specified as universal standards primarily aiming at failure diagnosis and adopted in the automobile industry. Correspondingly, the communication line 40 is adapted for an interface in conformity with the common communication standards (universal communication standards).

Unlike the governor control unit 17, the other control units 23, 33 and the monitors 45, 46 have interfaces in conformity with specific (dedicated) communication standards adapted for a construction machine. Correspondingly, the communication line 39 is adapted for those interfaces in conformity with the specific communication standards (dedicated communication standards).

The control units 23, 33 and the monitors 45, 46 transmit and receive signals (such as control data and monitoring data) required for control among them via the communication line 39, and also transmit and receive necessary signals with respect to the governor control unit 17 via the communication line 40 by utilizing a conversion function (described later) of the communication relay control unit 100.

Figure 2:
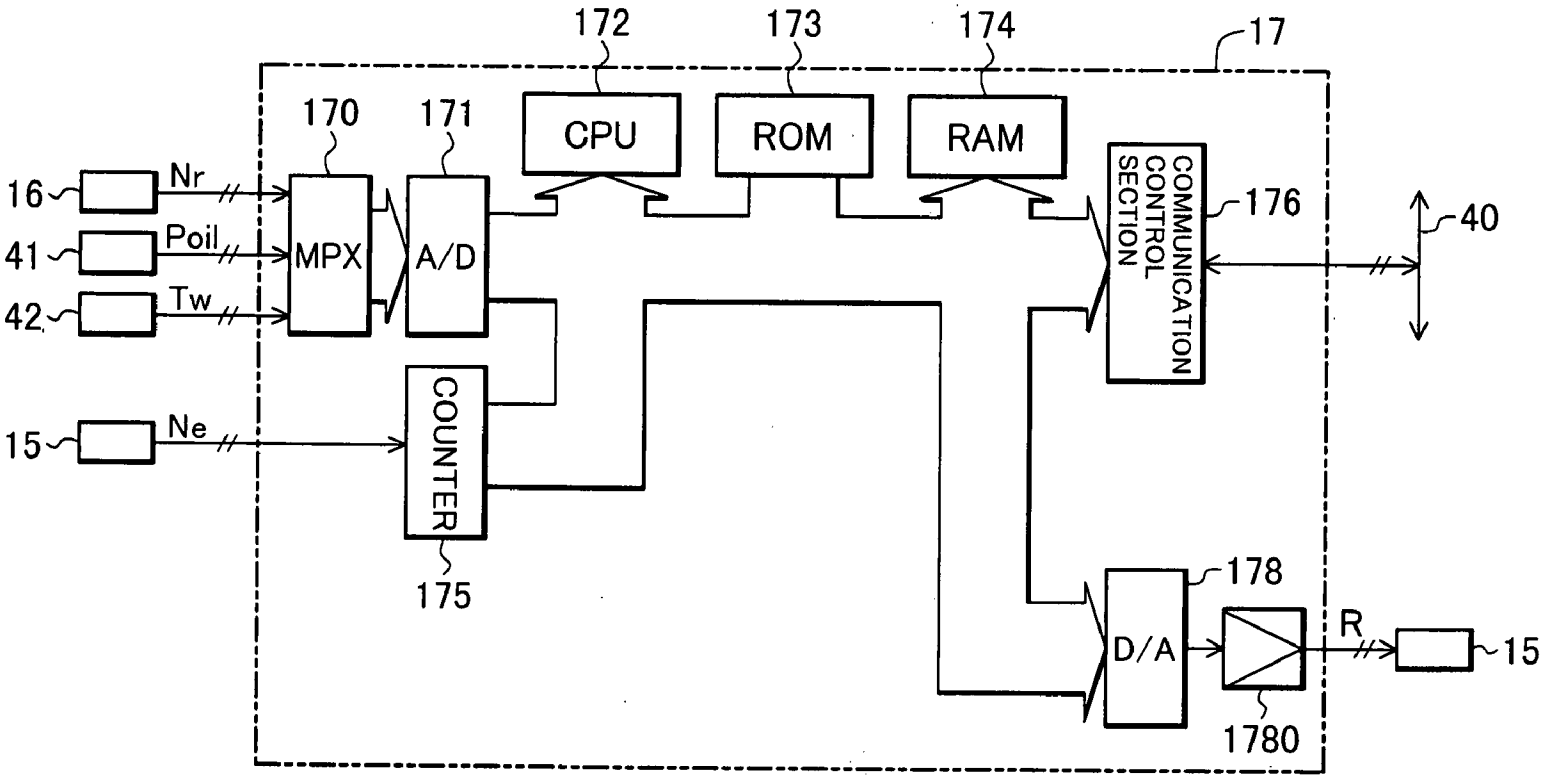
FIG. 2 is a functional block diagram showing a functional configuration of a governor control unit shown in FIG. 1.

FIG. 2 is a functional block diagram showing a functional configuration of the governor control unit 17. Referring to FIG. 2, the control unit 17 comprises a multiplexer 170 for selectively outputting the target revolution speed signal Nr from the throttle dial 16, the signal of the engine oil pressure Poil from the oil pressure sensor 41, and the signal of the cooling water temperature Tw from the water temperature sensor 42 to an A/D converter 171; the A/D converter 171 for converting an analog signal inputted from the multiplexer 170 into a digital signal; a counter 175 for receiving the signal (pulse signal) of the actual revolution speed Ne from the governor 15; a central processing unit (CPU) 172 for controlling the entirety of the control unit 17 in accordance with a program of control procedures and constants necessary for control, which are stored in a ROM 173; the read only memory (ROM) 173 for storing the program of the control procedures and the constants necessary for the control, which are executed by the CPU 172; a random access memory (RAM) 174 for temporarily storing computed results or numerical values during computations; a D/A converter 178 for converting a digital signal into an analog signal; an amplifier 1780 for outputting a signal from the D/A converter to the governor 15; and a communication control section 176 for controlling communication via the communication line 40.

Figure 3:
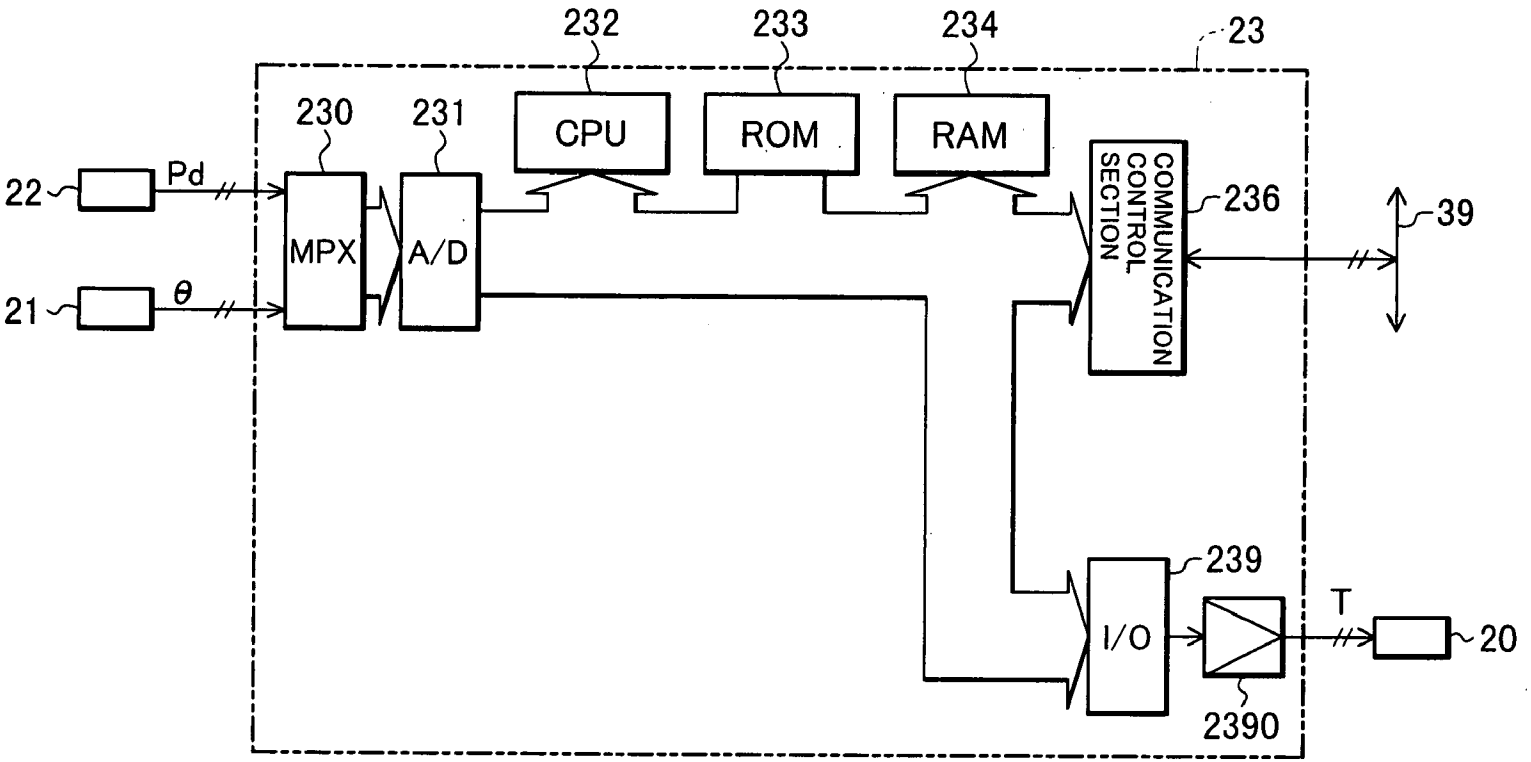
FIG. 3 is a functional block diagram showing a functional configuration of an excavator body control unit shown in FIG. 1.

FIG. 3 is a functional block diagram showing a functional configuration of the excavator body control unit 23. Referring to FIG. 3, the control unit 23 comprises a multiplexer 230 for selectively outputting the signal of the delivery pressure Pd from the pressure sensor 22 and the signal of the swash plate tilting angle θ from the swash plate position sensor 21 to an A/D converter 231; the A/D converter 231 for converting an analog signal inputted from the multiplexer 230 into a digital signal; a central processing unit (CPU) 232; a read only memory (ROM) 233 for storing a program of control procedures and constants necessary for control; a random access memory (RAM) 234 for temporarily storing computed results or numerical values during computations; an interface (I/O) 239 for outputting the control signal T for the swash plate 19 of the hydraulic pump 18 to the swash-plate position adjusting device 20 through a driving signal amplifier 2390; and a communication control section 236 for controlling communication via the communication line 39.

Figure 4:
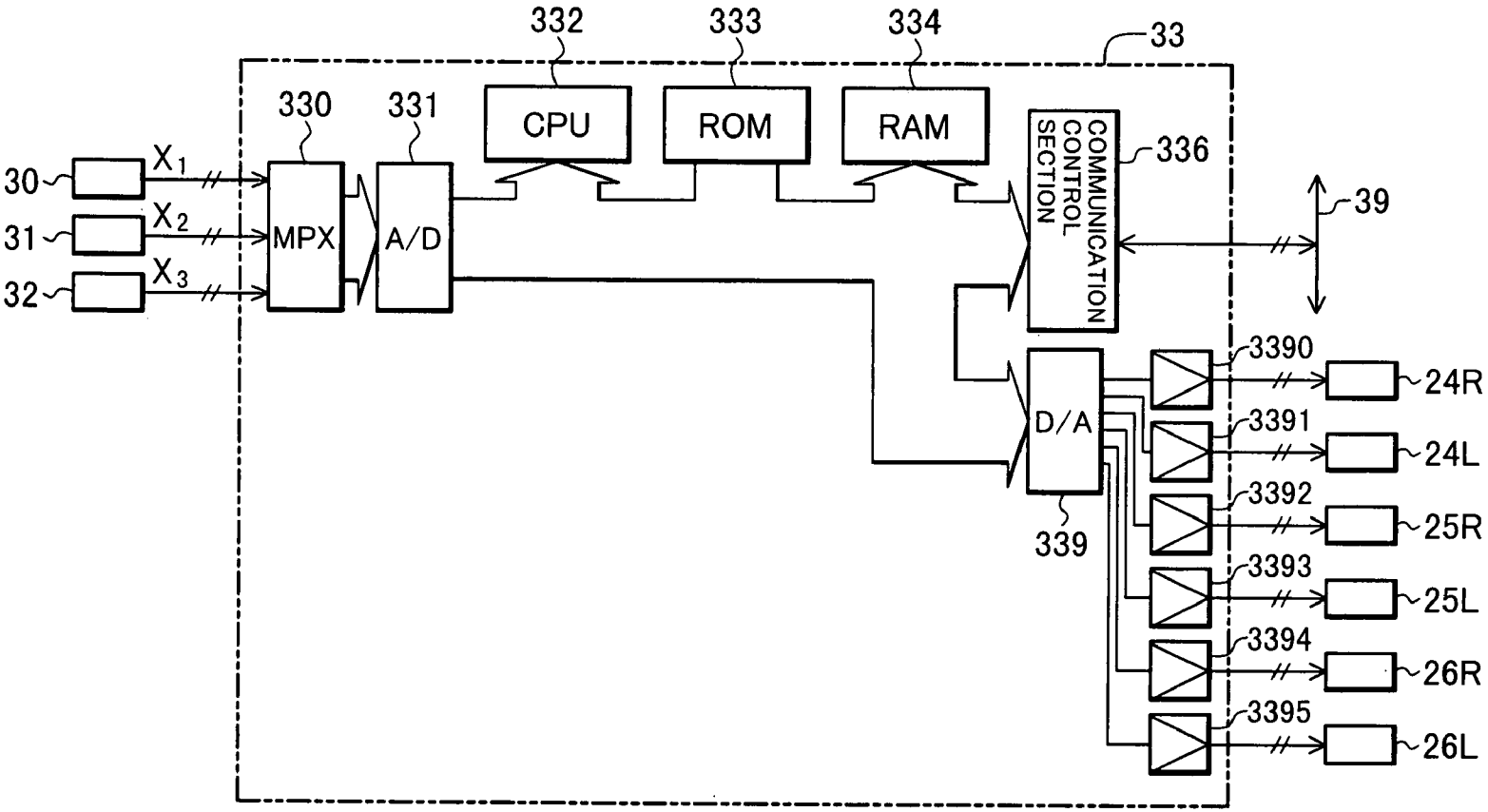
FIG. 4 is a functional block diagram showing a functional configuration of an electric lever control unit shown in FIG. 1.

FIG. 4 is a functional block diagram showing a functional configuration of the electric lever control unit 33. Referring to FIG. 4, the control unit 33 comprises a multiplexer 330 for selectively outputting the operation signals X1, X2 and X3 from the lever signal generators 30, 31 and 32 of the control levers 27, 28 and 29 to an A/D converter 331; the A/D converter 331 for converting an analog signal inputted from the multiplexer 330 into a digital signal; a central processing unit (CPU) 332 for controlling the entirety of the control unit in accordance with a program of control procedures and constants necessary for control, which are stored in a ROM 333; the read only memory (ROM) 333 for storing the program of the control procedures and the constants necessary for the control; a random access memory (RAM) 334 for temporarily storing computed results or numerical values during computations; a D/A converter 339 for converting a digital signal into an analog signal and outputting driving signals for solenoid proportional valves 24R, 24L, 25R, 25L, 26R and 26L associated with the control valves 24, 25 and 26 through respective amplifiers 3390 to 3395; and a communication control section 336 for controlling communication via the communication line 39.

Figure 5:
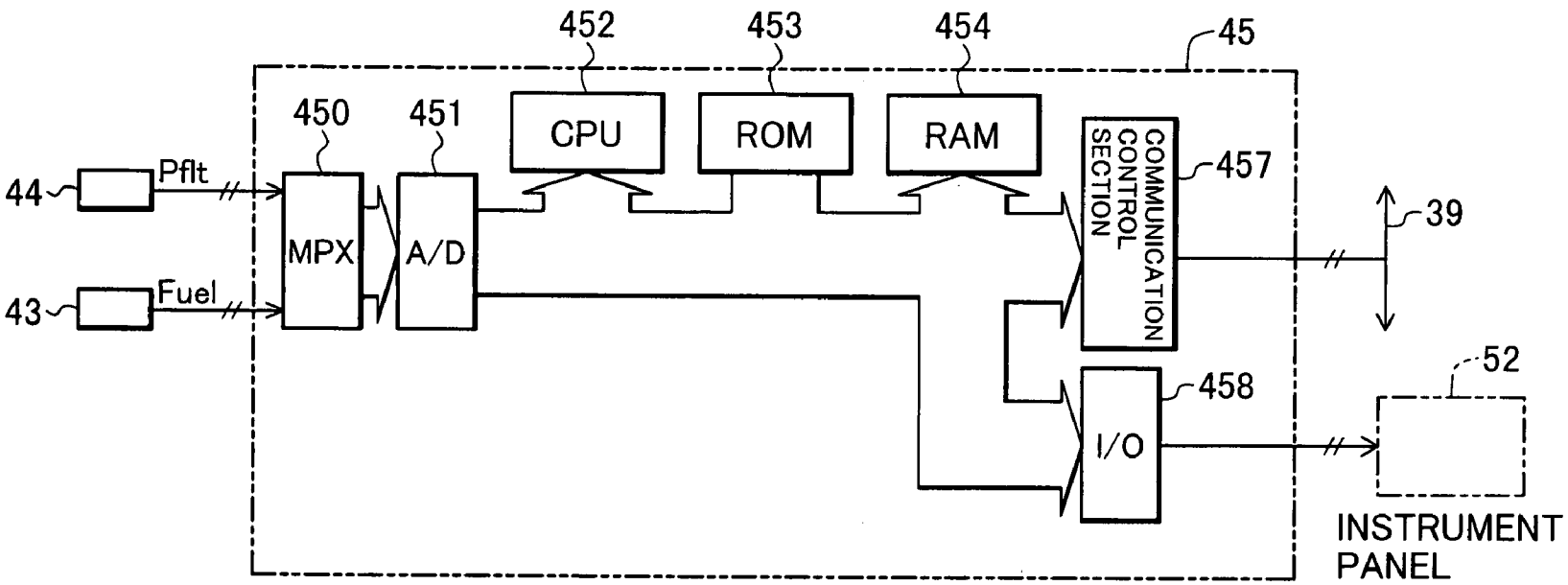
FIG. 5 is a functional block diagram showing a functional configuration of an excavator body information monitor shown in FIG. 1.

FIG. 5 is a functional block diagram showing a configuration of the excavator body information monitor 45. Referring to FIG. 5, the monitor 45 comprises a multiplexer 450 for selectively outputting the signal of the filter pressure Pflt from the pressure sensor 44 and the signal of the fuel level Fuel from the fuel level sensor 43 to an A/D converter 451; the A/D converter 451 for converting an analog signal inputted from the multiplexer into a digital signal; a central processing unit (CPU) 452 for controlling the entirety of the monitor in accordance with a program of monitoring procedures and constants necessary for computations, which are stored in a ROM 453; the read only memory (ROM) 453 for storing the program of the monitoring procedures and the constants necessary for the computations; a random access memory (RAM) 454 for temporarily storing computed results or numerical values during the computations; an interface (I/O) 458 for outputting signals to the instrument panel 52 in accordance with the signal of the fuel level Fuel, the signal of the filter pressure Pflt or the signals from the other control units and the monitors; and a communication control section 457 for controlling communication via the communication line 39.

Figure 6:
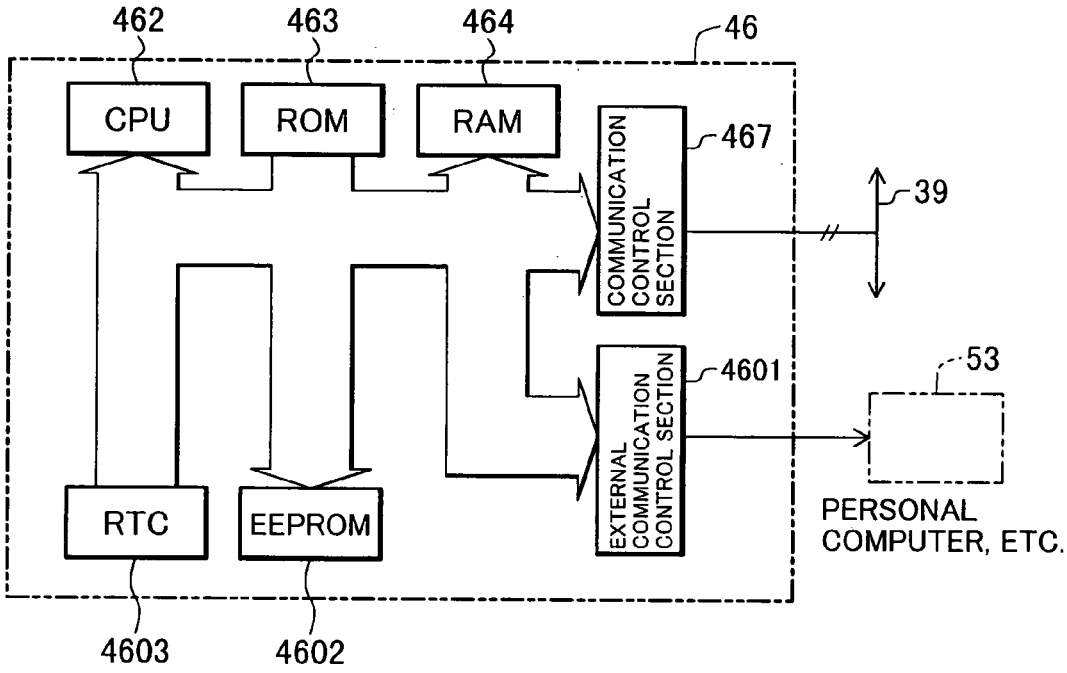
FIG. 6 is a functional block diagram showing a functional configuration of an operating information monitor shown in FIG. 1.

FIG. 6 is a functional block diagram showing a functional configuration of the operating information monitor 46. Referring to FIG. 6, the monitor 46 comprises a central processing unit (CPU) 462 for controlling the entirety of the monitor in accordance with a program of monitoring procedures and constants necessary for computations, which are stored in a ROM 463; the read only memory (ROM) 463 for storing the program of the monitoring procedures and the constants necessary for the computations; a random access memory (RAM) 464 for temporarily storing computed results or numerical values during the computations; a writable nonvolatile memory (EEPROM) 4602 for storing monitoring data processed in accordance with the signals inputted from the governor control unit 17 and the monitor 45; a real time clock (RTC) 4603 for outputting the current time; a communication control section 467 for controlling communication via the communication line 39; and an external communication control section 4601 for communicating the monitoring data stored in the EEPROM 4602 to the external device such as the PC 53.

Figure 7:
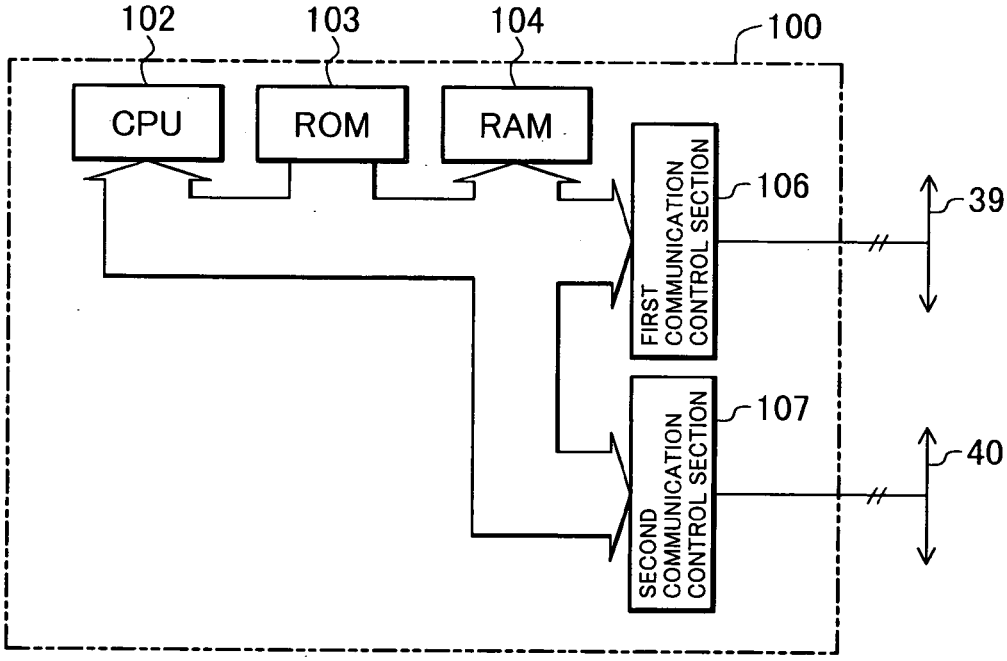
FIG. 7 is a functional block diagram showing a functional configuration of a communication relay control unit shown in FIG. 1.

FIG. 7 is a functional block diagram showing a functional configuration of the communication relay control unit 100. Referring to FIG. 7, the communication relay control unit 100 comprises a central processing unit (CPU) 102 for controlling the entirety of the control unit 100 in accordance with a program of control procedures and constants necessary for control, which are stored in a ROM 103 (described later); the read only memory (ROM) 103 for storing the program of the control procedures and the constants necessary for control, which are executed by the CPU 102; a random access memory (RAM) 104 for temporarily storing computed results or numerical values during computations; a communication control section 106 for controlling communication via the communication line 39; and a communication control section 107 for controlling communication via the communication line 40.

Next, a description is made of communication via the communication lines 39, 40.

FIG. 8 shows one example of data communicated via the communication lines 39, 40. In FIG. 8, "ID No." denotes an identification number allocated to individual data. Also, a mark ○ indicates data transmitted from any of the control units or the monitors, and a mark ● indicates data received by any of the control units or the monitors.

As shown in FIG. 8, as control system communication data, the target engine revolution speed Nr and the actual engine revolution speed Ne are transmitted from the governor control unit 17 to the communication relay control unit 100 for conversion therein via the communication line 40, and are then received by the excavator body control unit 23 via the communication line 39. The operation signals X1, X2 and X3 are also transmitted from the electric lever control unit 33 and are received by the excavator body control unit 23 via the communication line 39.

On the other hand, as monitor system communication data, the actual engine revolution speed Ne, the engine oil pressure Poil, and the engine cooling water temperature Tw are transmitted from the governor control unit 17 to the communication relay control unit 100 for conversion therein via the communication line 40, and are then received by the excavator body information monitor 45 and the operating information monitor 46 via the communication line 39. Further, the filter pressure Pflt and the fuel level Fuel are transmitted from the excavator body information monitor 45 and are then received by the operating information monitor 46 via the communication line 39.

In this connection, the term "cycle" shown in FIG. 8 indicates an interval at which one of the control units and the monitors receiving relevant data is set to utilize the relevant data, i.e., a time interval at which the relevant data is to be updated. The cycle is decided in consideration of a time interval at which the relevant data is required from the standpoint of control or monitoring, or a change speed of the relevant data. For example, since the target revolution speed Nr of the engine 14 received by the excavator body control unit 23 from the governor control unit 17 hardly changes after being once set, the cycle of about 50 mS is sufficient for the target engine revolution speed Nr. On the other hand, the cycle for the actual revolution speed Ne of the engine 14 received by the excavator body control unit 23 is required to be set to 20 mS in consideration of the change rate of the actual revolution speed Ne. Also, since the operation signals X1, X2 and X3 transmitted from the electric lever control unit 33 to the excavator body control unit 23 are required for computation of a target tilting angle Or of the hydraulic pump executed by the control unit 23, the cycle for each operation signal is required to be set to about 10 mS.

Figure 9:
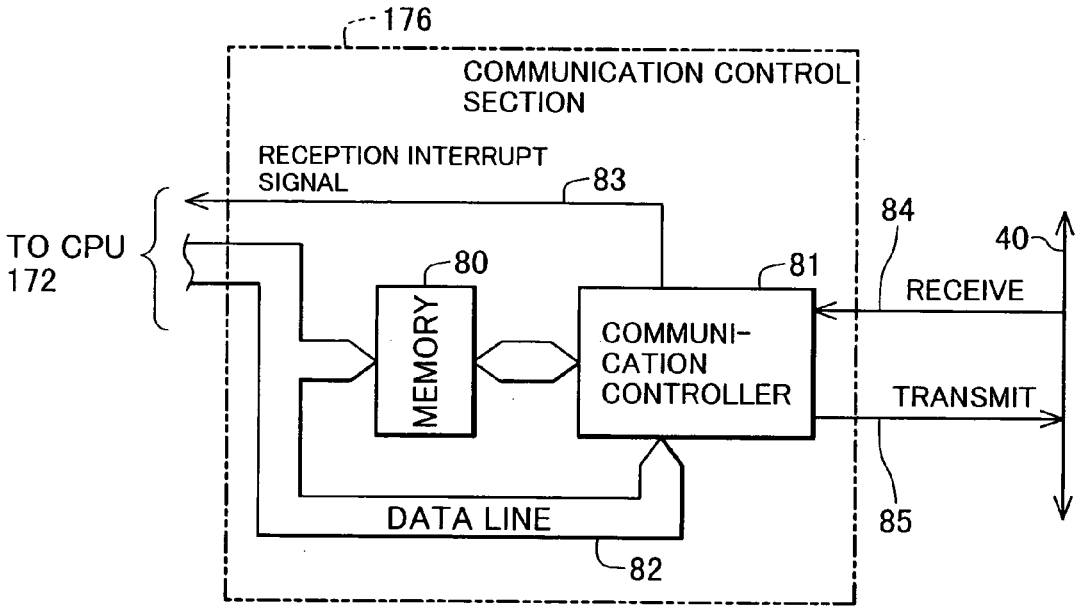
FIG. 9 is a functional block diagram showing a functional configuration of first and second communication control sections.

FIG. 9 is a functional block diagram showing one example of a configuration of the communication control section 176 in the governor control unit 17. In FIG. 9, the same characters as those in FIGS. 1 and 2 denote the same components. The communication control section 176 comprises a memory 80 having storage locations for management of data by using the same number as ID No. assigned to each data, a communication controller 81, a data line 82 connected to the CPU 172 in the control unit 17, an interrupt signal line 83 for sending a reception interrupt signal from the communication controller 81 to the CPU 172 in the control unit 17 in the reception mode, and a reception line 84 and a transmission line 85 for connecting the communication controller 81 and the communication line 40 to each other.

Note that, though not described here in detail, the other communication sections 236, 336, 457 and 467 in the other control units 23, 33 and the monitors 45, 46 each also have basically the same configuration as the communication control section 176.

Next, a manner of transmitting and receiving data will be described in detail. As described above with reference to FIG. 8, each data must be transmitted in accordance with a predetermined cycle required in the receiving side, and the cycle varies to a large extent from about 10 msec to about 1 sec depending on the type of data. In this embodiment, therefore, data transmission and reception at the cycle of 10 to 100 msec are performed by automatically transmitting the data from the transmitting side at each corresponding cycle (described later in detail) as practiced for the target engine revolution speed Nr and the actual engine revolution speed Ne which are transmitted in the order of the governor control unit 17→the communication relay control unit 100→the excavator body control unit 23, the operation signals X1, X2 and X3 which are transmitted in the order of the electric lever control unit 33→the excavator body control unit 23, and the actual engine revolution speed Ne which is transmitted in the order of the governor control unit 17→the communication relay control unit 100→the excavator body information monitor 45 and the operating information monitor 46.

On the other hand, data transmission and reception at the other cycle of 1 sec are performed by transmitting the data from the transmitting side in response to a transmission request from the receiving side as practiced for the engine oil pressure Poil and the engine cooling water temperature Tw in the order of the governor control unit 17→the communication relay control unit 100→the excavator body information monitor 45 and the operating information monitor 46, and the filter pressure Pflt and the fuel level Fuel which are transmitted in the order of the governor control unit 17→the excavator body information monitor 45 and the operating information monitor 46.

(1) Automatic Transmission and Reception at Predetermined Cycle (Including Conversion)

To begin with, a manner of automatically transmitting and receiving data at each predetermined cycle will be described. Taking as an example the case of communicating the target engine revolution speed Nr from the governor control unit 17 to the excavator body control unit 23, a description is first made of a manner of transmitting data on the side of the governor control unit 17 in that case.

(1-1) Transmission

Figure 10:
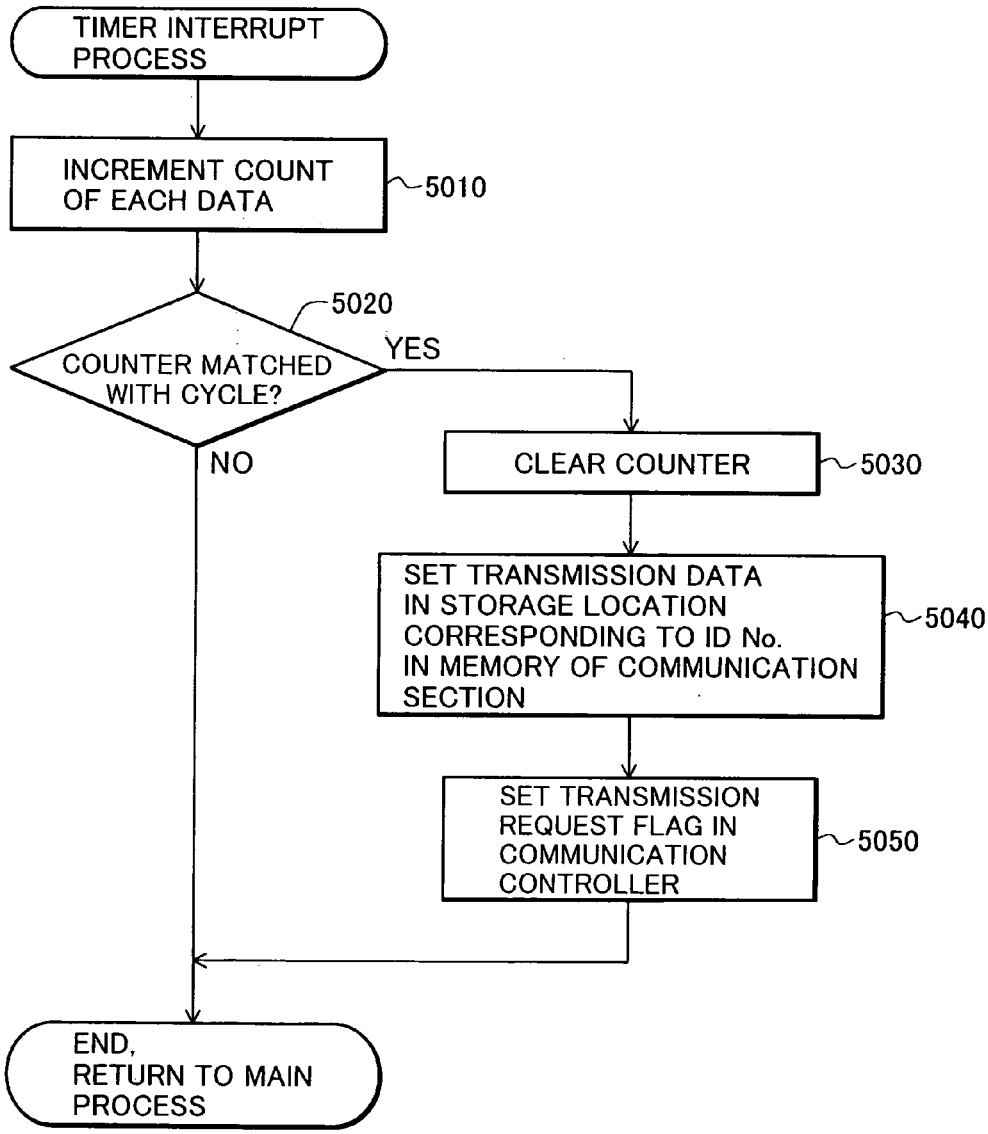
FIG. 10 is a flowchart for explaining a timer interrupt process of a CPU.

The above-mentioned CPU 172 in the governor control unit 17 generates a timer interrupt at intervals of a certain time, e.g., 1 msec, by a timer (not shown) and suspends a main process (described later) to start up a timer interrupt process program. FIG. 10 is a flowchart showing the timer interrupt process program. Detailed processing steps in accordance with the program will be described below with reference to FIG. 10.

Step 5010:

The counter provided for each data is incremented by one (+1). Thus, in this STEP, each counter is updated whenever a timer interrupt generates. For example, if the timer interrupt is to be executed at intervals of 1 msec, each counter is updated per 1 msec.

Step 5020:

It is then determined whether the value of each counter is matched with the transmission cycle set for each data as shown in FIG. 8. If they are not matched with each other, the timer interrupt process is brought to an end at once for return to the main process. If it is determined in STEP 5020 that the counter value is matched with the cycle, the process flow proceeds to steps following STEP 5030.

Step 5030:

The counter value corresponding to the data, for which the counter value has been matched with the cycle, is cleared to zero (0).

Step 5040:

The transmission data, for which the counter value has been matched with the cycle, is stored in the memory 80 of the communication control section 176 at a storage location corresponding to the ID No.

Step 5050:

A communication request flag for the communication controller 81 is set, thereby causing the communication control section 176 to start a transmission process. After the end of this STEP, the timer interrupt process is brought to an end for return to the main process. Taking as an example the target engine revolution speed Nr among the data transmitted from the governor control unit 17 shown in FIG. 8, because the transmission cycle is 50 msec, the counter value is matched with the cycle and STEP 5030 to 5050 are executed whenever the timer interrupt process is repeated 50 times.

Figure 11:
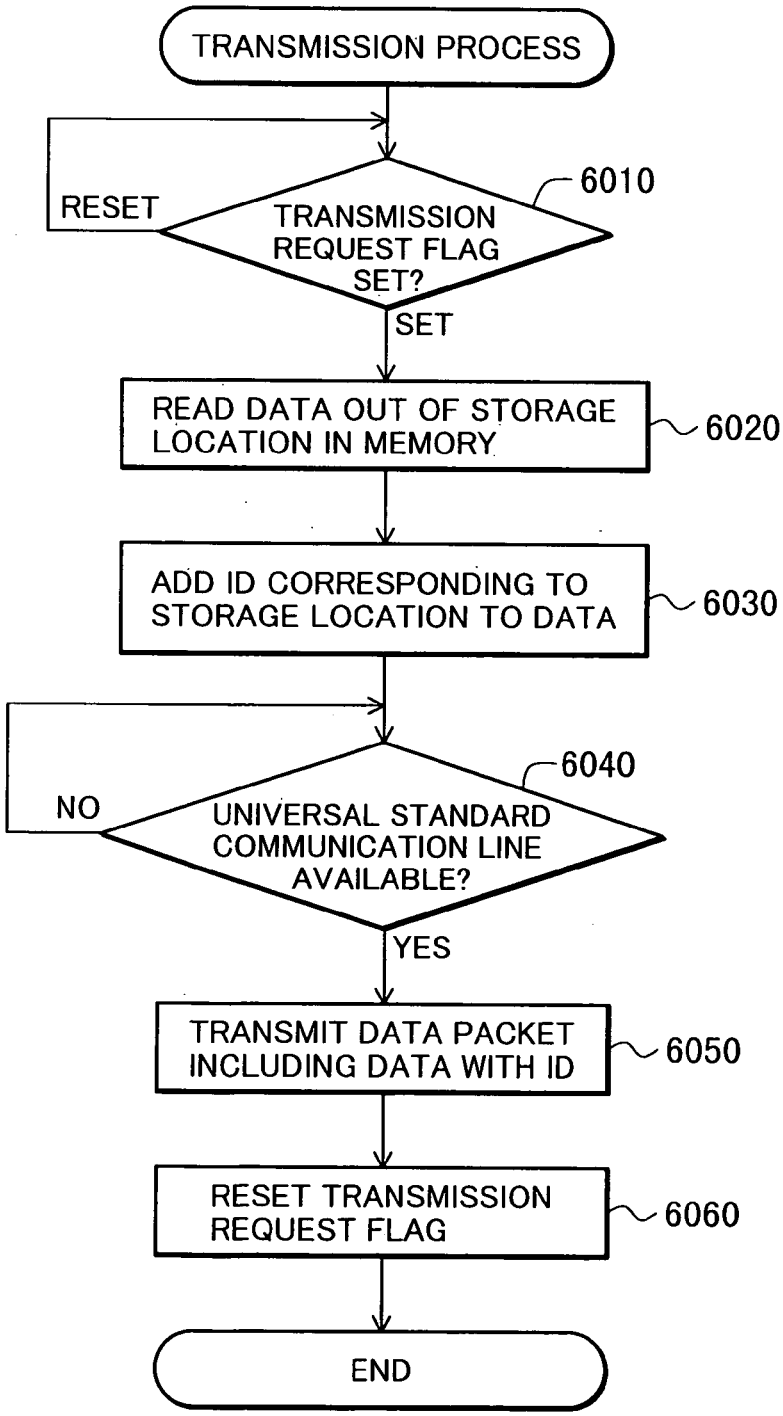
FIG. 11 is a flowchart for explaining a data transmission process of the communication control section.

After the completion of the above-described processing by the CPU 172, the communication controller 81 in the communication control section 176 shown in FIG. 9 executes a predetermined transmission process and transmits control data to the communication line 40. FIG. 11 is a flowchart showing detailed operation of the transmission process executed by the communication controller 81. Detailed processing steps of the transmission process will be described below with reference to FIG. 11.

Step 6010:

The communication controller 81 monitors whether the transmission request flag is set in the communication controller 81. If the flat is set, the process flow proceeds to STEP 6020.

Step 6020:

The controller 81 reads the data at the storage location in the memory 80, which has been written by the CPU 172.

Step 6030:

An ID corresponding to the storage location is added to the read data.

Step 6040:

The controller 81 monitors whether the common standard communication line 40 is available. If the communication line 40 is available, the process flow proceeds to STEP 6050.

Step 6050:

The data added with the ID is converted into time-serial data to prepare a data packet which is transmitted to the communication line 40.

Step 6060:

The transmission request flag in the communication controller 81 is reset so as to be capable of receiving a next transmission request from the CPU.

(1-2) Relay and Conversion

Figure 12:
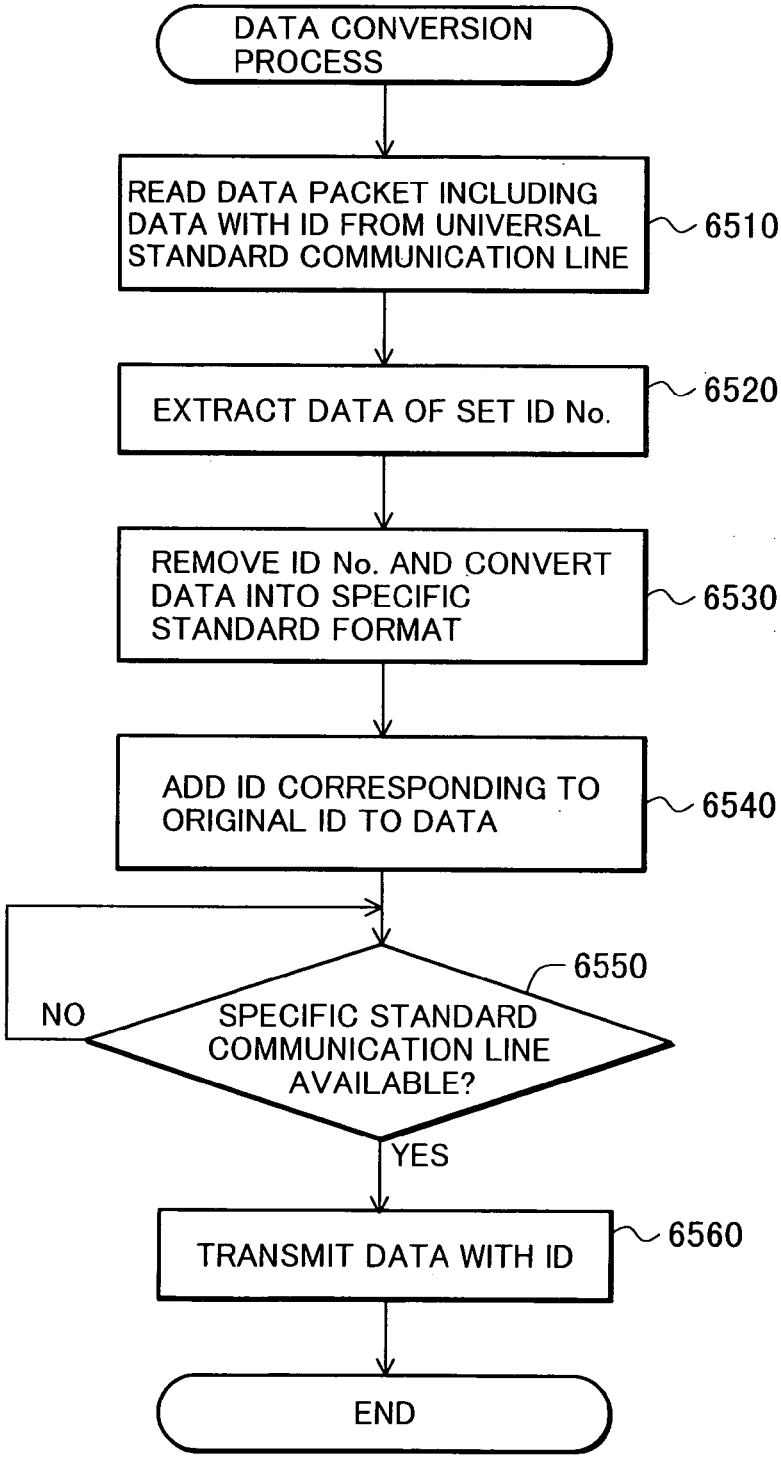
FIG. 12 is a flowchart showing a process executed by the communication relay control unit.

Next, a description is made of a manner of relaying and converting data in the communication relay control unit 100. FIG. 12 is a flowchart showing a process executed by the communication relay control unit 100. Detailed processing steps of the process will be described below with reference to FIG. 12

Step 6510:

The second communication control section 107 reads a data packet including all of the data transmitted via the common standard communication line 40.

Step 6520:

The second communication control section 107 extracts the data in the read data packet having the ID No. that is set beforehand by the CPU 102.

Step 6530:

The CPU 102 removes the ID No. from the extracted data and converts the control information affixed to the data packet, the data size, the communication cycle, etc. so that the data is in conformity with the specific (dedicated) standard format.

Step 6540:

The CPU 102 adds, to the converted data, ID that corresponds to the initially affixed ID.

Step 6550:

The first communication control section 106 monitors an available state of the specific standard communication line 39. If the communication line 39 is available, the process flow proceeds to STEP 6560.

Step 6560:

The first communication control section 106 converts the data added with the ID into time-serial data to prepare a data packet, and then transmits the data packet to the communication line 39.

(1-3) Reception

Figure 13:
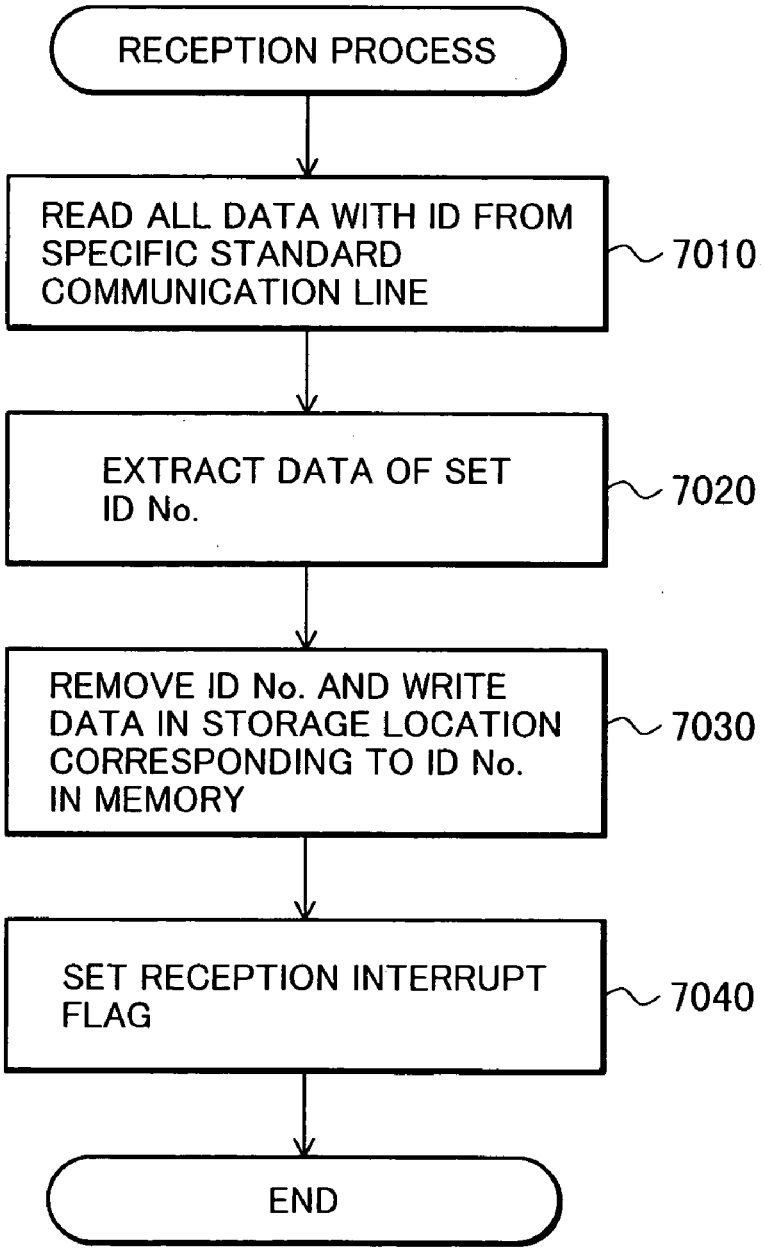
FIG. 13 is a flowchart for explaining a data reception process of the communication control section.

Finally, a description is made of a manner of receiving data in the excavator body control unit 23. FIG. 13 is a flowchart showing a process executed by the communication controller 81 in the communication control section 236 of the excavator body control unit 23. Detailed processing steps of the process will be described below with reference to FIG. 13

Step 7010:

The communication controller 81 reads the data packet including all of the data transmitted via the specific standard communication line 39.

Step 7020:

The communication controller 81 extracts the data in the read data packet having the ID No. identical to that set beforehand in the communication controller 81 by the CPU 232.

Step 7030:

The ID No. is removed from the extracted data, and resulting data is stored at the storage location in the memory 80 corresponding to the ID No.

Step 7040:

A reception interrupt flag is set in the communication controller 81 for informing the completion of the reception to the CPU 232, and a reception interrupt signal is issued to the CPU 232.

Figure 14:
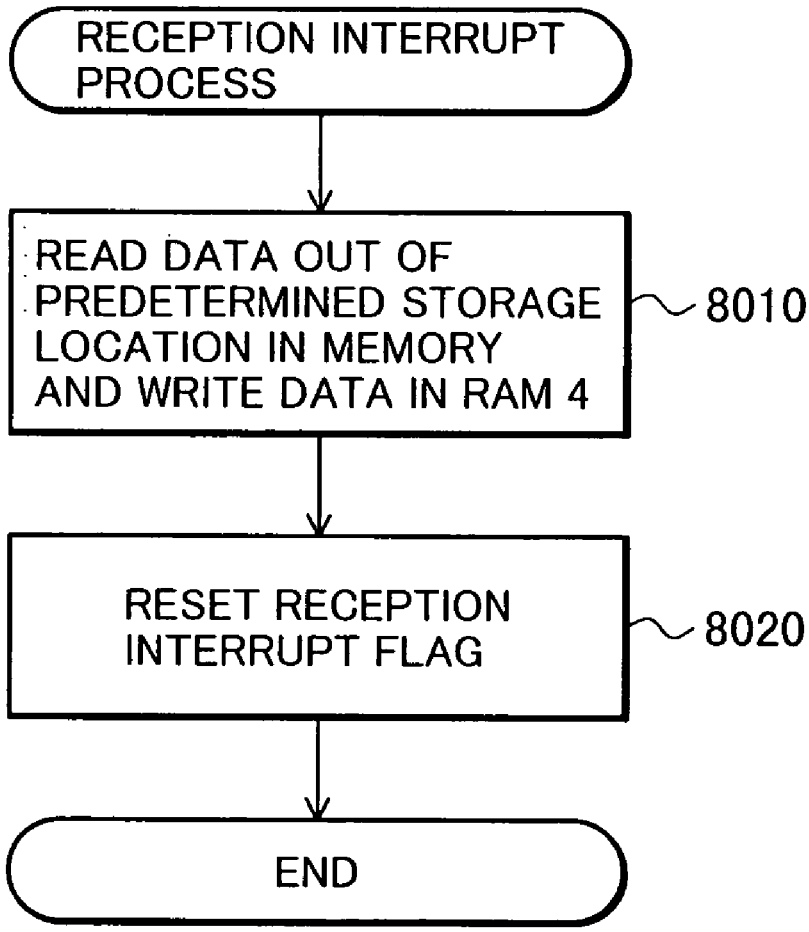
FIG. 14 is a flowchart for explaining a reception interrupt process of the CPU.

The CPU 232 receives the reception interrupt signal from the communication controller 81 of the communication control section 236 and suspends a main process (described later) to start up a reception interrupt process. FIG. 14 is a flowchart showing the reception interrupt process. Detailed processing steps of the reception interrupt process will be described below with reference to FIG. 14.

Step 8010:

The CPU 232 reads the data from the predetermined storage location corresponding to the ID No. in the memory 80 of the communication control section 236, and writes the read data in the RAM 234.

Step 8020:

A reception interrupt flag in the communication controller 81 is reset.

Figure 15:
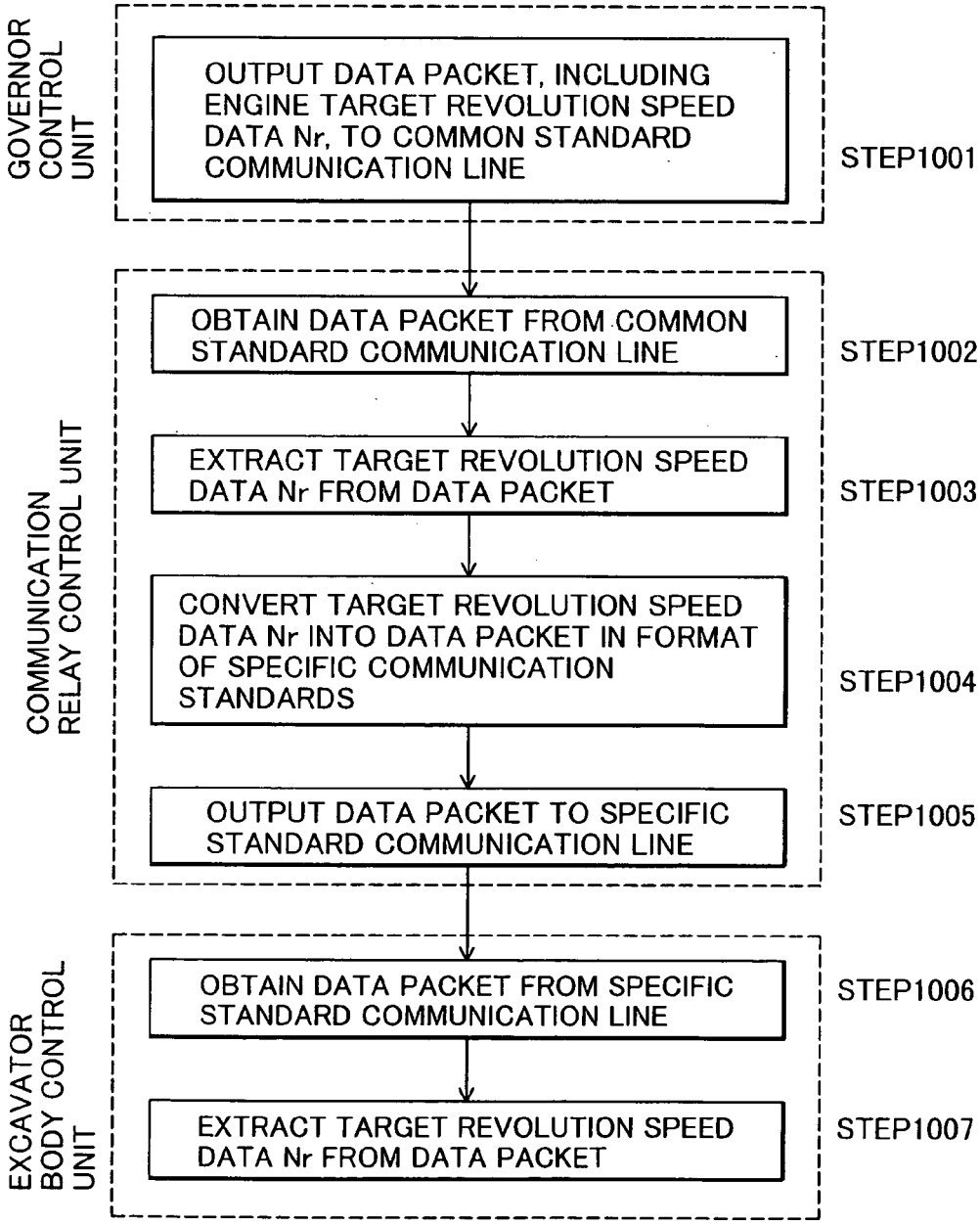
FIG. 15 is a process flow schematically showing an overall communication flow of target engine revolution speed data.

As described above, the target engine revolution speed Nr, for example, transmitted from the governor control unit 17 at intervals of 50 msec is converted in the communication relay control unit 100 at the cycle at which the relevant data has been transmitted, and thereafter the excavator body control unit 23 executes the data reception process at the same cycle. FIG. 15 is a process flow, comprising STEP 1001 to STEP 1007, schematically showing an overall communication flow of the target engine revolution speed Nr.

Note that, while the above description is made of, by way of example, the target engine revolution speed Nr transmitted from the governor control unit 17 to the excavator body control unit 23 at intervals of 50 msec, the actual engine revolution speed Ne transmitted from the governor control unit 17 to the excavator body control unit 23 is also processed in a similar manner except that the cycle is 20 msec.

Also, while the above description is made of, by way of example, the data transmission executed in the order of the governor control unit 17→the communication relay control unit 100→the excavator body control unit 23, the other types of data communication including conversion can also be executed as data transmission and reception via the communication lines 40, 39 with similar processing and operations even when, for example, the actual engine revolution speed Ne is transmitted at the cycle of 100 msec in the order of the governor control unit 17→the communication relay control unit 100→the excavator body information monitor 45 and the operating information monitor 46. As a matter of course, the communication relay control unit 100 is able to execute not only the conversion from the side of the common standard communication line 40 to the side of the specific standard communication line 39, but also the conversion in the reversed direction. In other words, for those ones of the communication data outputted in accordance with the specific communication standards from the control units 23, 33 and the monitors 45, 46 each connected to the specific standard communication line 39, which are necessary in the control unit 17 connected to the common standard communication line 40, the communication relay control unit 100 has the function of converting the control information affixed to the data packet, the data size, the communication cycle, etc. so that the data is in conformity with the common standards, followed by transmitting the converted data to the communication line 40.

(2) Transmission and Reception in Response to Transmission Request Command (Including Conversion)

The above case (1) has been described in connection with the mode of automatically transmitting data from the transmitting side at the predetermined cycle. On the other hand, since the cycle required for the engine oil pressure Poil and the engine cooling water temperature Tw communicated in the order of the governor control unit 17→the communication relay control unit 100→the excavator body information monitor 45 and the operating information monitor 46 is relatively long as described above, those data are transmitted from the transmitting side in response to a transmission request from the receiving side. In this case, the governor control unit 17 executes a transmission process in response to a transmission request from the communication control sections 457, 467 of the excavator body information monitor 45 and the operating information monitor 46. More specifically, the CPU 172 in the governor control unit 17 generates an interrupt in response to the transmission request and suspends a main process (described later) to start up a program for a transmission request interrupt process.

Figure 16:
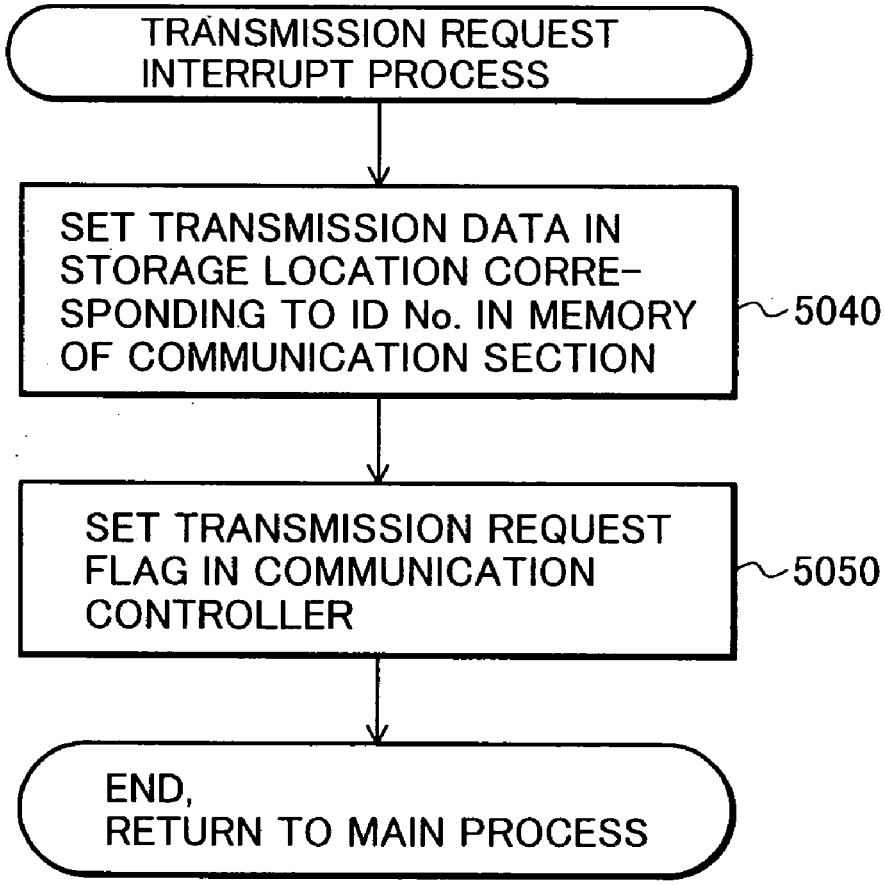
FIG. 16 is a flowchart for explaining a transmission request interrupt process of the CPU.

FIG. 16 is a flowchart showing the program for the transmission request interrupt process. Identical steps to those in FIG. 10 are denoted by the same characters. Though neither described in detail nor illustrated herein, a transmission request command signal for the engine oil pressure Poil (or the engine cooling water temperature Tw; this alternative is similarly applied to the following description), which is destined for the governor control unit 17, is outputted to the specific standard communication line 39 at the cycle of, e.g., 1 sec from the communication control section 457 of the excavator body information monitor 45 (or the communication control section 467 of the operating information monitor 46; this alternative is similarly applied to the following description). Correspondingly, the CPU 102 of the communication relay control unit 100 converts the transmission request command signal into another one adapted for the common standard communication line 40. Thereafter, the converted transmission request command signal is received by the communication control section 176 of the governor control unit 17.

When the transmission request command signal is received in such a manner, the interrupt process program shown in FIG. 16 is started up. First, in STEP 5040 similar to that shown in FIG. 10, the transmission data is written in the memory 80 of the communication control section 176 at the predetermined storage location corresponding to the ID No. of the data.

Then, in STEP 5050, the communication request flag for the communication controller 81 is set, thereby causing the communication control section 176 to start a transmission process. After the end of this STEP, the timer interrupt process is brought to an end for return to the main process.

In this way, the interrupt process is executed at the communication cycle of 1 sec, followed by execution of STEP 5040 and STEP 5050.

After the completion of the above-described processing by the CPU 172, similarly to the above (1-1), the communication controller 81 in the communication control section 176 of the governor control unit 17 executes a predetermined transmission process and transmits control data to the common standard communication line 40. Processing steps in that transmission process are similar to those shown in the process flow shown in FIG. 11, and hence a detailed description is omitted here. Correspondingly, the communication relay control unit 100 executes a relay and conversion process. Processing steps of that relay and conversion process are similar to those shown in the process flow shown in FIG. 12, and hence a detailed description is omitted here. Finally, a reception process executed by the communication control section 457 of the excavator-body information monitor 45 is similar to that shown in the process flow shown in FIGS. 13 and 14, and hence a detailed description is omitted here.

Figure 17:
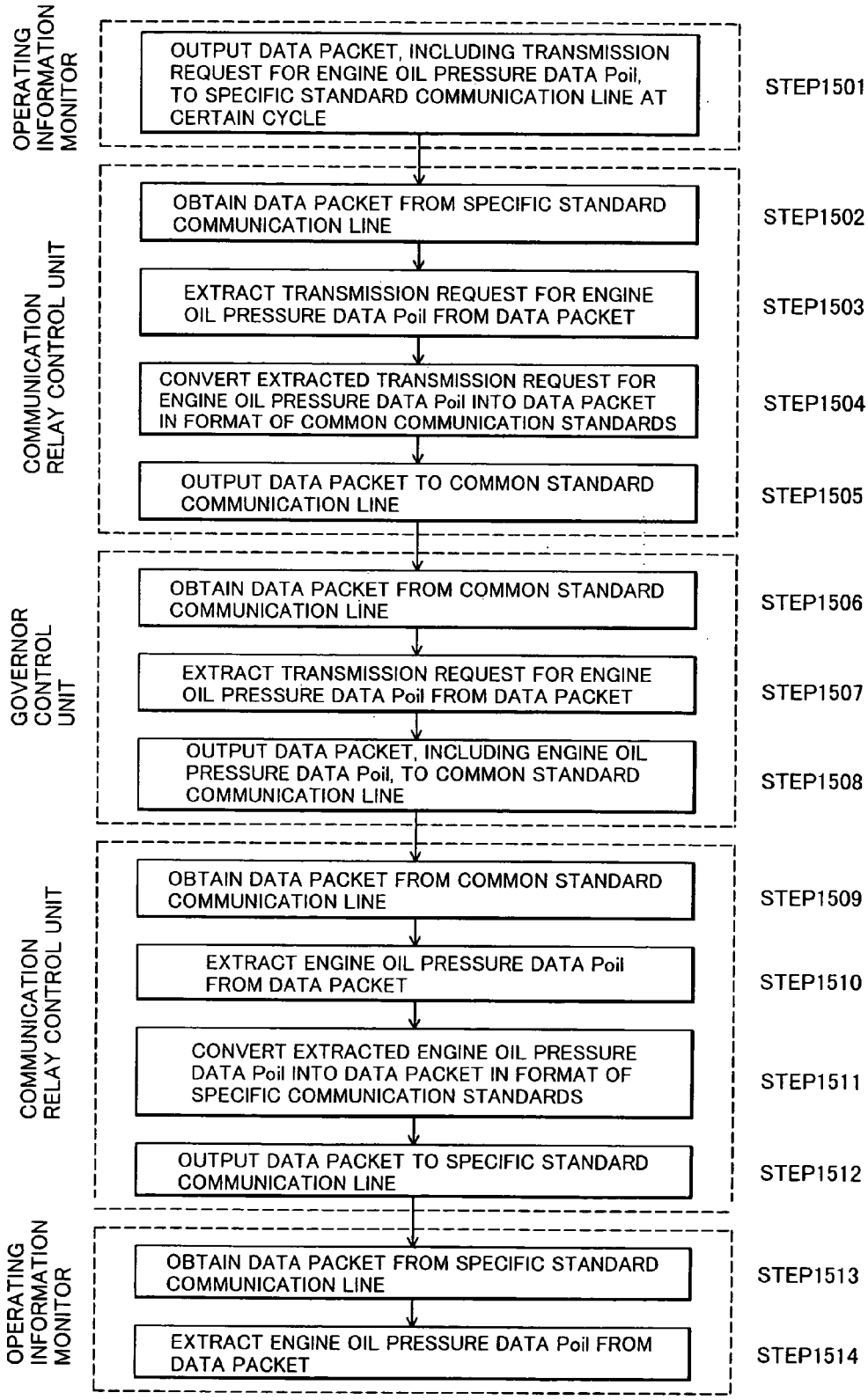
FIG. 17 is a process flow schematically showing an overall communication flow of engine oil pressure data.

FIG. 17 is a process flow, comprising STEP 1501 to STEP 1514, schematically showing an overall communication flow of the engine oil pressure Poil.

(3) Transmission and Reception Without Conversion

The above (1) and (2) have been each described in connection with the case of converting data to be adapted for the specific standards by the communication relay control unit 100 to which the data is sent from the governor control unit 17 via the common standard communication line 40, and thereafter communicating the converted data to the excavator body control unit 23, the excavator body information monitor 45, etc. via the specific standard communication line 39. On the other hand, among the control units 23, 33 and the monitors 45, 46 interconnected via the common standard communication line 40, data is directly transmitted and received without conversion executed by the communication relay control unit 100.

In such a case, as with the above (1), the operation signals X1, X2 and X3, which require a relatively short cycle and are communicated in the order of the electric lever control unit 33→the excavator body control unit 23, may be automatically transmitted from the transmitting side at the corresponding cycle. In this occasion, the CPU 332 in the electric lever control unit 33 executes a timer interrupt process program similar to the process flow shown in FIG. 10. Then, the communication controller 81 in the communication control section 336 executes transmission processing steps similar to the process flow shown in FIG. 11 (except that "common standard communication line" in STEP 6040 is replaced by "specific standard communication line"). Correspondingly, the communication controller 81 in the communication control section 236 of the excavator body control unit 23 executes reception processing steps similar to the process flow shown in FIG. 13. Thereafter, the CPU 23 responsively executes a reception interrupt process similar to the process flow shown in FIG. 14.

Also, the filter pressure Pflt and the fuel level Fuel, which require a relatively long cycle and are transmitted in the order of the governor control unit 17→the excavator body information monitor 45 and the operating information monitor 46, may be triggered from the transmitting side in response to a transmission request from the receiving side as with the above case (2) (detailed description is omitted here).

Next, the main process of each of the control units 17, 23, 33 and the monitors 45, 46 will be described.

Figure 18:
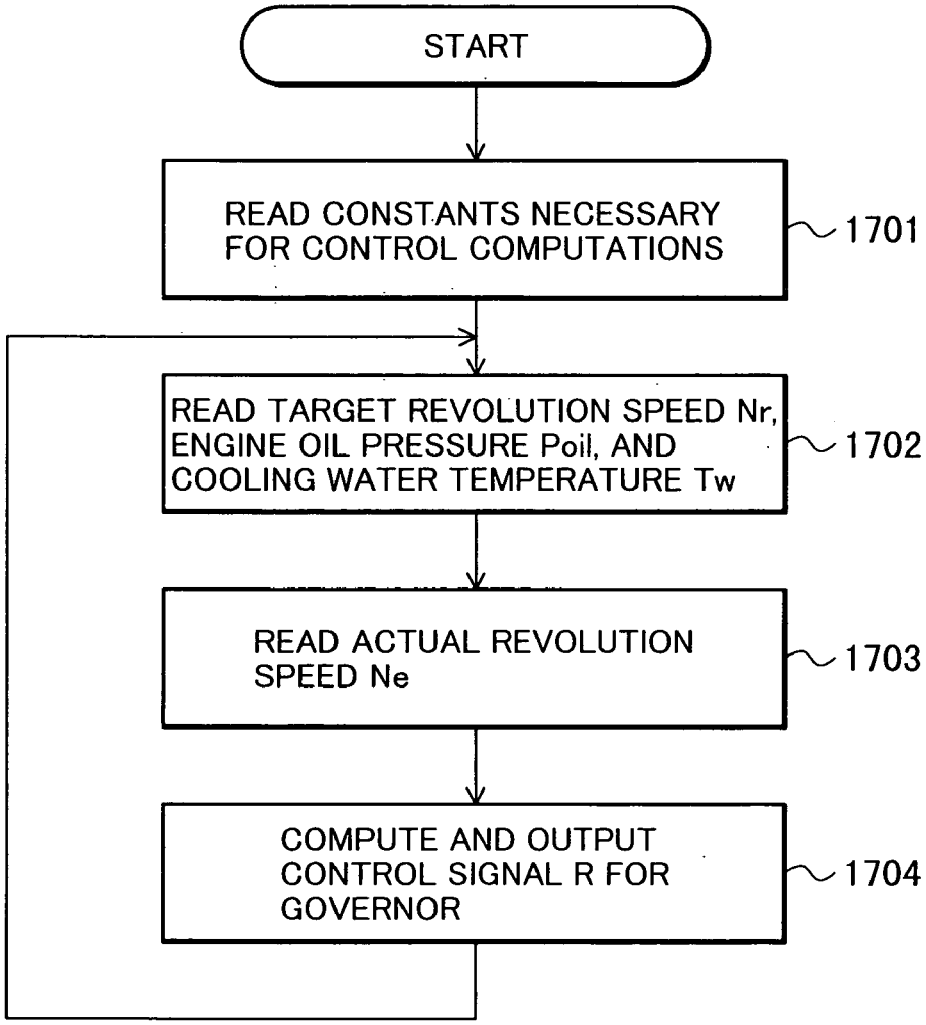
FIG. 18 is a flowchart for explaining a main process of the governor control unit.

A description is first made of the main process of the governor control unit 17 with reference to FIG. 18.

FIG. 18 is a flowchart showing a control program stored in the ROM 173 of the governor control unit 17. The ROM 173 starts up the control program upon power-on and executes processing given below.

Step 1701:

The CPU 172 reads the constants necessary for control computations from the ROM 173.

Step 1702:

The CPU reads the respective signals of the target revolution speed Nr from the throttle dial 16, the engine oil pressure Poil, and the cooling water temperature Tw through the A/D converter.

Step 1703:

The CPU receives the signal of the actual engine revolution speed Ne of the engine 14 from the governor 15 through the counter 175.

Step 1704:

The CPU outputs the control signal R to the governor 15 so that the actual engine revolution speed Ne is matched with the target engine revolution speed Nr. The revolution speed of the engine 14 is thereby controlled.

Then, the process flow returns to STEP 1702 to repeat the processing described above.

Next, the main process of the excavator body control unit 23 will be described with reference to FIG. 19.

Figure 19:
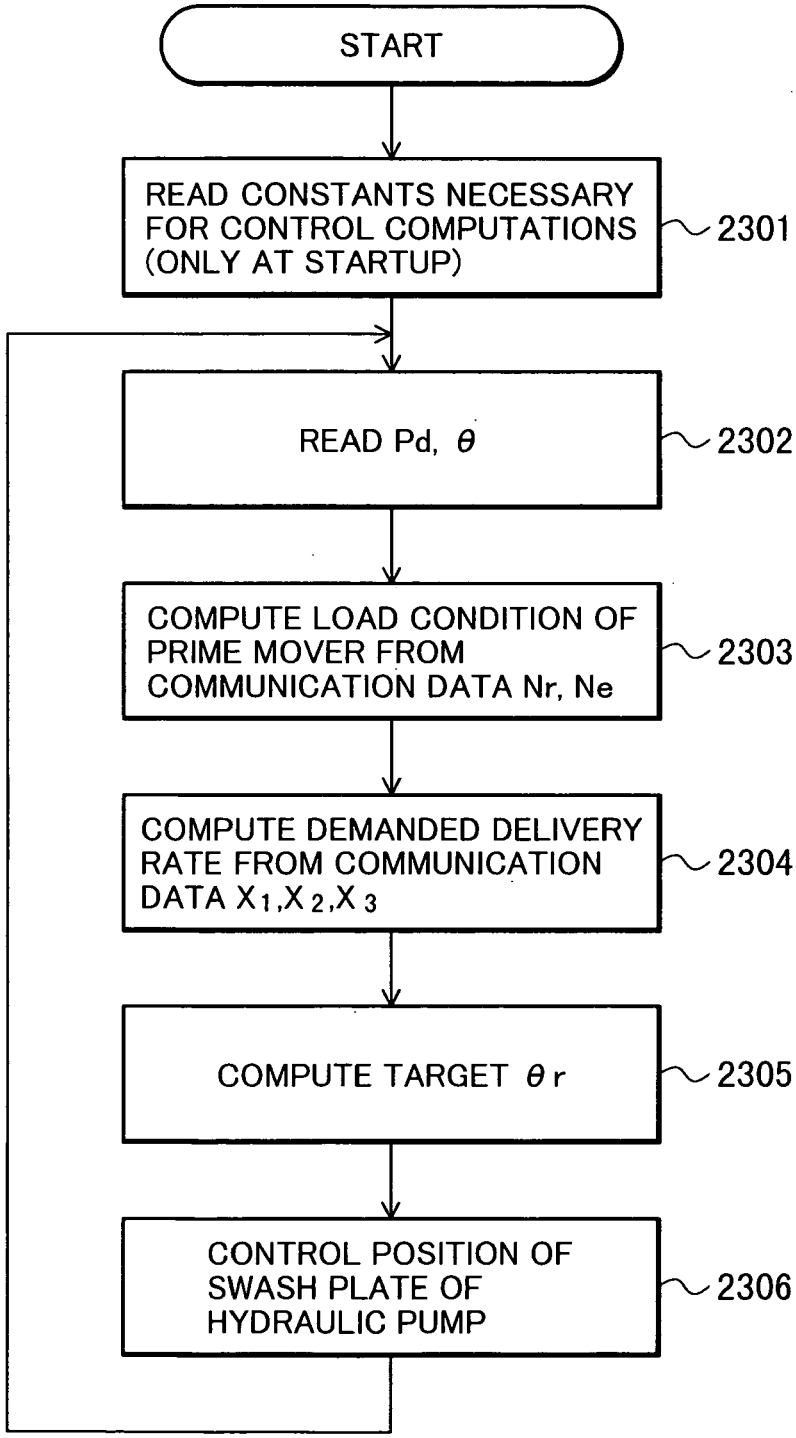
FIG. 19 is a flowchart for explaining a main process of the excavator body control unit.

FIG. 19 is a flowchart showing a control program stored in the ROM 233 of the excavator body control unit 23. The ROM 233 starts up the control program upon power-on and executes processing given below.

Step 2301:

The CPU 232 reads the constants necessary for control computations from the ROM 233.

Step 2302:

The CPU reads the respective signals of the delivery pressure Pd from the pressure sensor 22 and the swash plate tilting angle θ from the swash plate position sensor 21 through the A/D converter.

Step 2303:

The load condition of the engine 14 is computed, as described above, using the communication data representative of Nr, Ne which are obtained from the governor control unit 17 through the conversion made in the communication relay control unit 100.

Step 2304:

The delivery rate of the hydraulic fluid demanded for the hydraulic pump 18 is computed using the communication data representative of X1, X2 and X3 which are directly obtained from the electric lever control unit 33 via the communication line 39 of the specific communication standard.

Step 2305:

Based on the demanded delivery rate of the hydraulic pump thus computed, the CPU computes the available delivery rate of the hydraulic pump from both the engine load condition and Pd, and then calculates the target tilting angle θr from the computed available delivery rate.

Step 2306:

The CPU outputs a control signal to the swash-plate position adjusting device 20 so that the swash plate tilting angle θ is matched with the target tilting angle θr. The tilting angle of the swash plate 19 of the hydraulic pump 18 is thereby controlled.

Then, the process flow returns to STEP 2302 to repeat the processing described above.

Next, the main process of the electric lever control unit 33 will be described with reference to FIG. 20.

Figure 20:
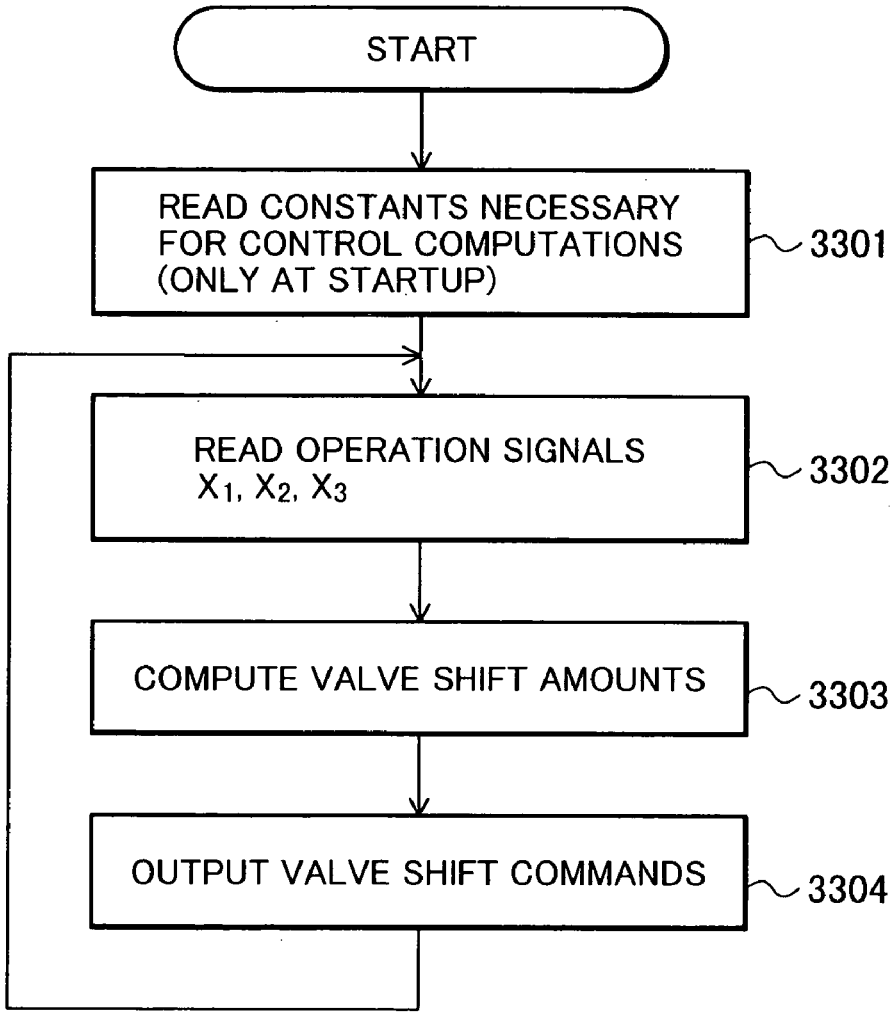
FIG. 20 is a flowchart for explaining a main process of the electric lever control unit.

FIG. 20 is a flowchart showing a control program stored in the ROM 333 of the electric lever control unit 33. The ROM 333 starts up the control program upon power-on and executes processing given below.

Step 3301:

The CPU 332 reads the constants necessary for control computations from the ROM 333.

Step 3302:

The CPU reads the operation signals X1, X2 and X3 from the control levers 27, 28 and 29 through the A/D converter 331.

Step 3303:

The respective valve shift amounts corresponding to the operation signals X1, X2 and X3 are computed.

Step 3304:

The CPU outputs respective operation commands to the solenoid proportional valves 24R to 24L driving the control valves through the D/A converter 337 and the amplifiers 3390 to 3395. Then, the process flow returns to STEP 3302.

Next, the main process of the excavator body information monitor 45 will be described with reference to FIG. 21.

Figure 21:
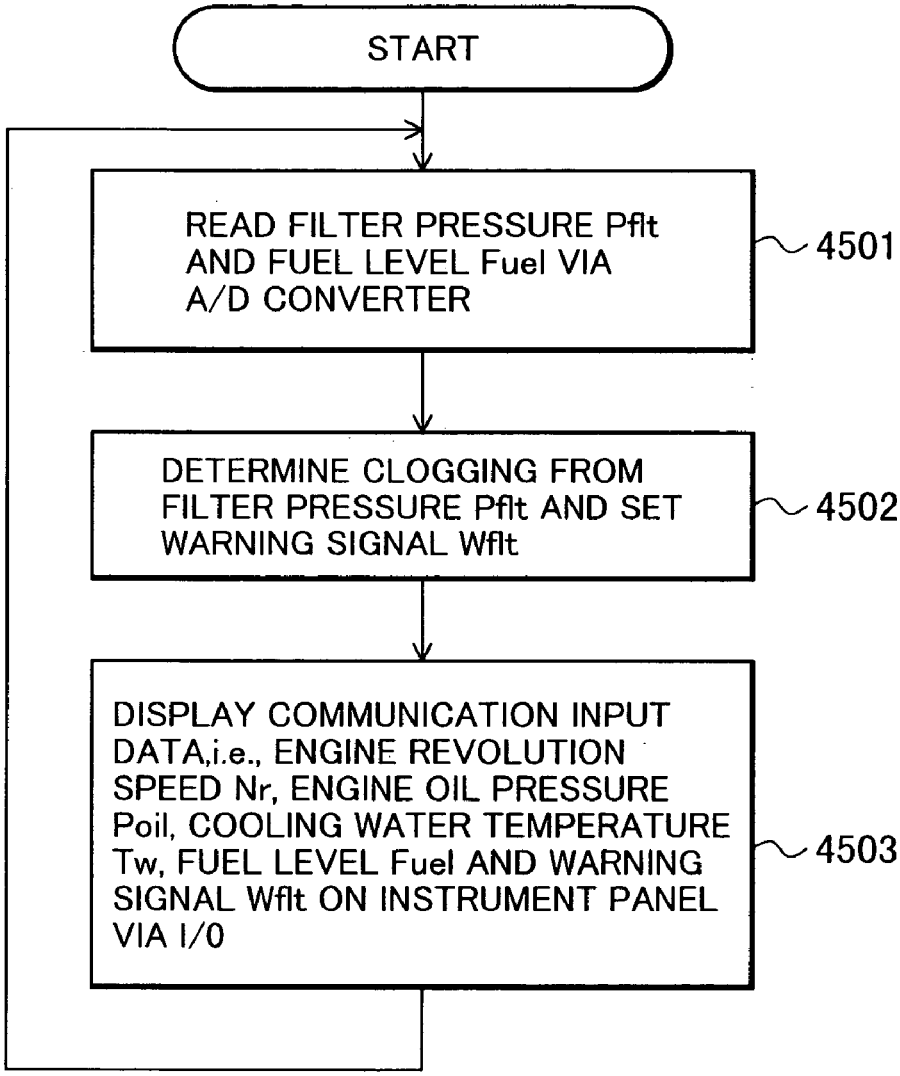
FIG. 21 is a flowchart for explaining a main process of the excavator body information monitor.

FIG. 21 is a flowchart showing a control program stored in the ROM 453 of the excavator body information monitor 45. The ROM 453 starts up the control program upon power-on and executes processing given below.

Step 4501:

The CPU 452 receives the respective signals of the filter pressure Pflt and the fuel level Fuel through the A/D converter 451.

Step 4502:

The CPU determines the occurrence of clogging based on the filter pressure and sets a warning signal Wflt.

Step 4503:

The respective values of the actual revolution speed of the engine 14, the engine oil pressure Poil, and the cooling water temperature Tw, which are inputted from the communication line 39 through the conversion made in the communication relay control unit 100 as described above, and the respective values of the fuel level Fuel and the warning signal Wflt both inputted in the preceding STEP 4501 are displayed in the instrument panel via the I/O 458.

Then, the process flow returns to STEP 4501.

Next, the main process of the operating information monitor 46 will be described with reference to FIGS. 22 to 30.

Figure 22:
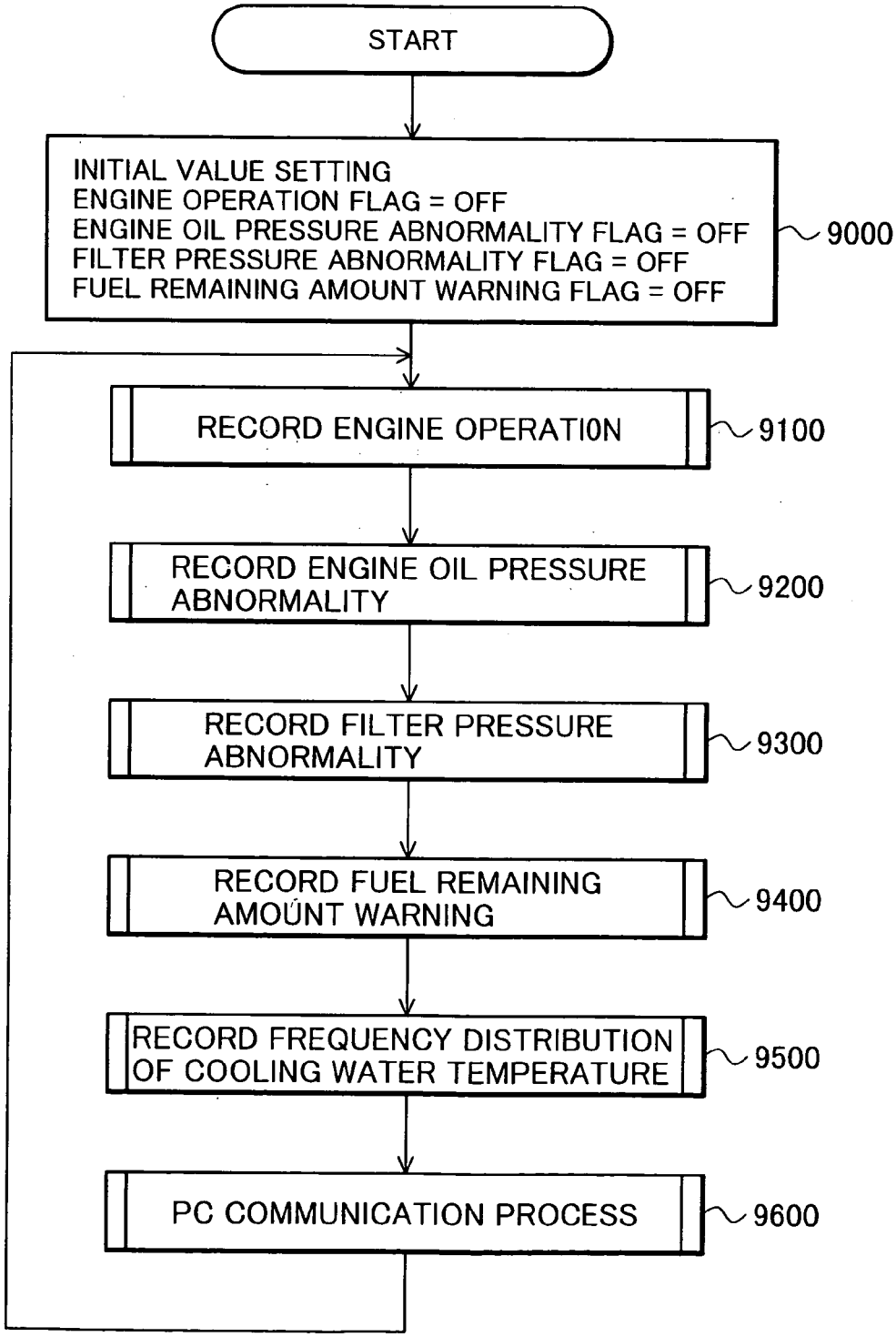
FIG. 22 is a flowchart for explaining an overall flow of a main process of the operating information monitor.

FIG. 22 is a flowchart showing a control program stored in the ROM 463 of the operating information monitor 46.

First, when the monitor 46 is supplied with electric power and the program is started up, initial values are set in block 9000. Here, an engine operation flag, an engine oil pressure abnormality flag, a filter pressure abnormality flag, and a fuel remaining amount warning flag all used in later blocks 9100 to 9400 are each set to an off-state.

Figure 23:
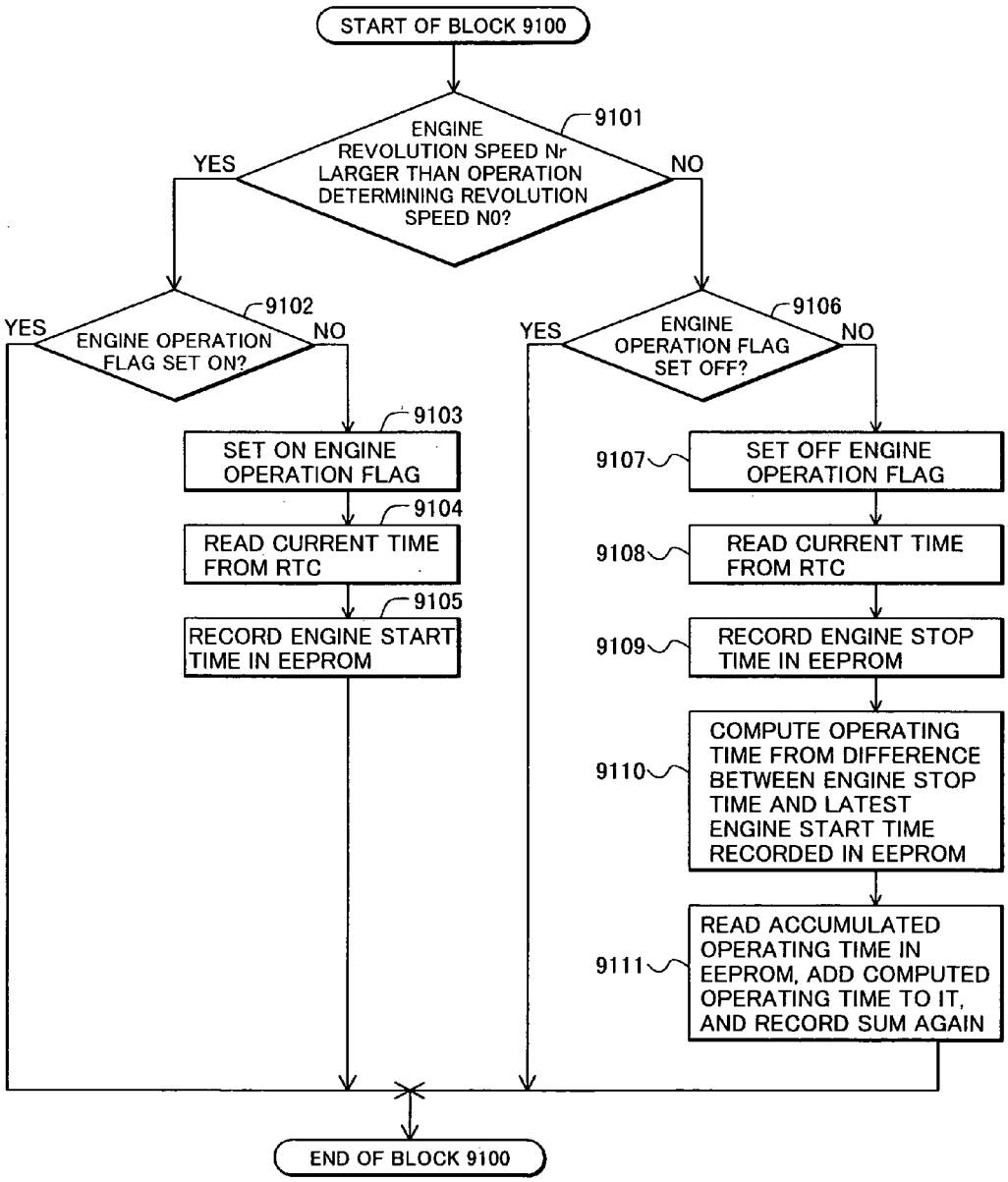
FIG. 23 is a flowchart for explaining details of an engine operation recording process in the main process of the operating information monitor.

Then, an engine operation recording process of block 9100 is executed. Details of this process are shown in FIG. 23. The process of block 9100 will be described below with reference to FIG. 23.

Step 9101:

The CPU 462 determines whether the actual revolution speed (engine revolution speed) Ne of the engine 14, which is received from the communication line 39 through the conversion made in the communication relay control unit 100 as described above, is larger than an engine operation determining revolution speed NO. If Ne is larger than NO, the process flow proceeds to STEP 9102. If Ne is smaller than NO, the process flow proceeds to STEP 9106. The operation determining revolution speed NO used in this STEP is set to, e.g., a value slightly lower than the idle revolution speed of the engine 14.

Step 9102:

If the engine revolution speed Ne is larger than the operation determining revolution speed NO, the CPU determines whether the engine operation flag indicating whether the engine 14 was operating when this process was executed in the previous cycle, is set ON (this means that the engine was operating). If the engine operation flag is set ON, the process of block 9100 is brought to an end because there is no status change as compared with the previous cycle. If the engine operation flag is set OFF, the process flow proceeds to STEP 9103. In the initial condition, the engine operation flag is set OFF and hence the process flow always proceeds to STEP 9103.

Step 9103:

The engine operation flag is set ON to indicate the operation of the engine 14.

Step 9104:

The current time is read from the RTC 4603.

Step 9105:

The engine start time is recorded in the EEPROM 4602. The engine start time is recorded in the EEPROM in the form of "year, month, day, time, and START", for example, as an engine operation record shown in FIG. 24. Then, the processing of block 9100 is brought to an end.

Step 9106:

On the other hand, if it is determined in STEP 9101 that the actual revolution speed Ne of the engine 14 is smaller than the operation determining revolution speed $N_0$ STEP 9106 is executed. In this STEP, the CPU determines whether the engine operation flag is set OFF. If the engine operation flag is set OFF, the process of block 9100 is brought to an end because there is no status change as compared with the previous cycle. If the engine operation flag is set ON, the process flow proceeds to STEP 9107.

Step 9107:

The engine operation flag is set OFF to indicate the stop of the engine.

Step 9108:

The current time is read from the RTC 4603.

Step 9109:

The engine stop time is recorded in the EEPROM 4602. Similarly to the engine start time mentioned above, the engine stop time is recorded in the EEPROM in the form of "year, month, day, time, and STOP", for example, as the engine operation record shown in FIG. 24.

Step 9110:

Then, the CPU reads the latest engine start time recorded as the engine operation record in the EEPROM 4602, and computes, as the operating time, the difference between the read latest engine start time and the current engine stop time. In the example of FIG. 24, the latest engine start time is "2000.1.28 AM 9:10", and the current engine stop time is "2000.1.28 PM 4:30". The difference therebetween is therefore 7 hours and 20 minutes. This value represents a time period in which the engine 14 was operating.

Step 9111:

Thereafter, the CPU reads the accumulated engine operation time stored in the EEPROM 4602, adds the operating time computed in STEP 9110 to the read time, and stores the sum again as the accumulated engine operation time in the EEPROM 4602. Block 9100 is then brought to an end.

Figure 25:
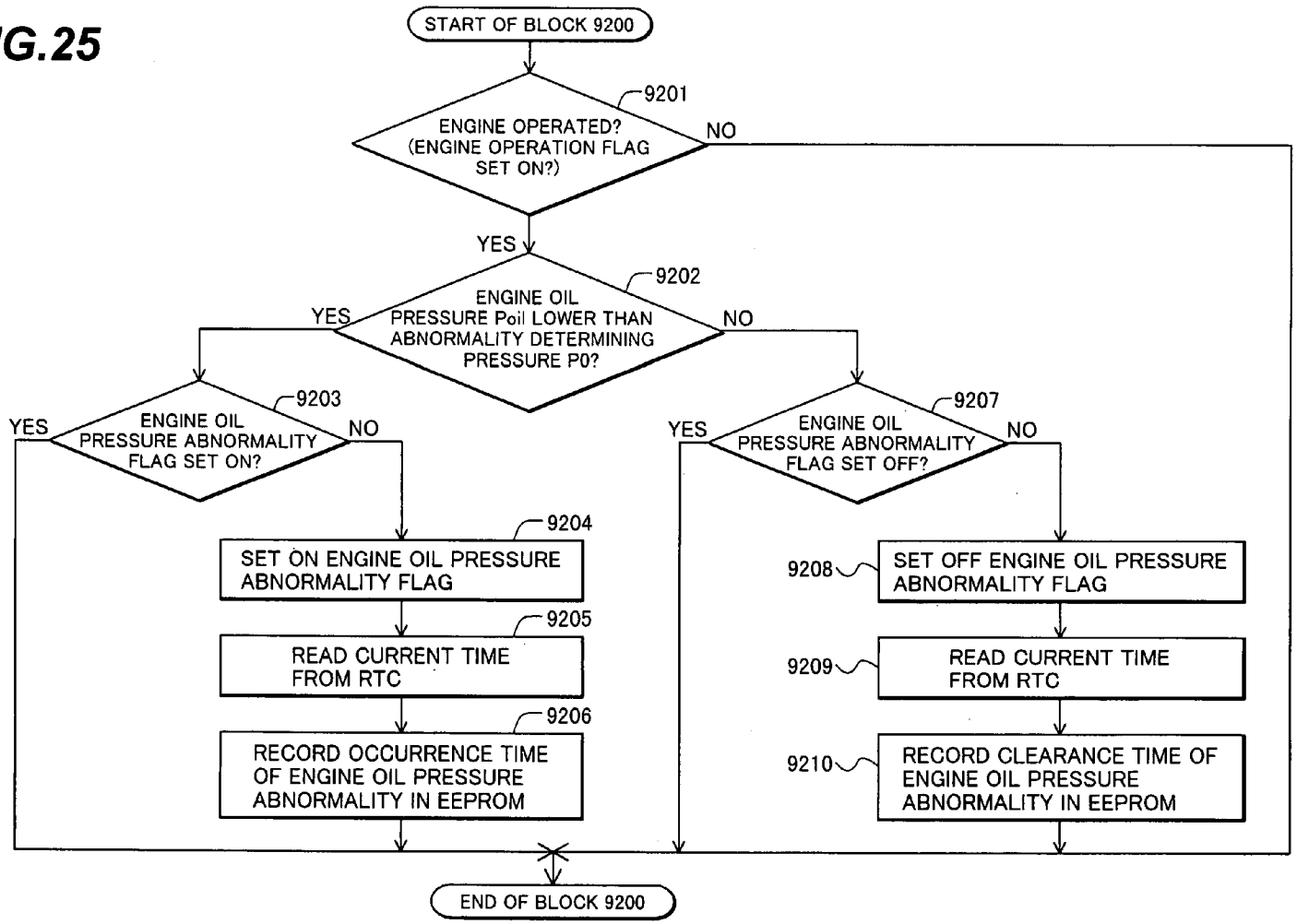
FIG. 25 is a flowchart for explaining details of an engine oil-pressure abnormality recording process in the main process of the operating information monitor.

Subsequent to the completion of block 9100, block 9200 is executed. FIG. 25 is a flowchart showing detailed steps of block 9200. Block 9200 will be described below with reference to FIG. 25.

Step 9201:

First, whether the engine 14 is operated or not is determined by checking whether the engine operation flag is set ON. If the engine 14 is not operated (if the engine operation flag is set OFF), block 9200 is brought to an end. If the engine is operated, the process flow proceeds to STEP 9202.

Step 9202:

The CPU determines whether the engine oil pressure Poil, which is received from the governor control unit 17 via the communication line 39 through the conversion made in the communication relay control unit 100 as described above, is lower than an abnormality determining pressure P0. If so, this condition is determined to be abnormal and the process flow proceeds to STEP 9203. If the engine oil pressure Poil is higher than the abnormality determining pressure P0, this condition is determined to be normal and the process flow proceeds to STEP 9207.

Step 9203:

If the engine oil pressure Poil is determined to be abnormal in STEP 9202, the CPU determines whether the engine oil pressure abnormality flag at the current time is set ON. If the engine oil pressure abnormality flag is set ON, this means that the abnormal condition is continued. Therefore, block 9200 is brought to an end at once. If it is determined that the engine oil pressure abnormality flag is not set ON, i.e., the flag is set OFF, the process flow proceeds to STEP 9204.

Step 9204:

The engine oil pressure abnormality flag is set ON.

Step 9205:

The current time is read from the RTC 4603.

Step 9206:

The occurrence time of the engine oil pressure abnormality is stored in the EEPROM 4602 in the form of "year, month, day, hour, minute, and ON" at a storage location in the EEPROM corresponding to the engine oil pressure abnormality as shown in FIG. 24. Block 9200 is then brought to an end.

When the operating information monitor 46 is started up in this case, the engine oil pressure abnormality flag is set OFF in the initial value setting 9000. Accordingly, at a point in time when the engine oil pressure abnormality occurs for the first time after the startup, the processing is executed through STEP 9202-9203-9204-9205-9206, whereby the engine oil pressure abnormality flag is set ON.

Step 9207:

On the other hand, if it is determined in STEP 9202 that the engine oil pressure is not abnormal (i.e., Poil≧P0), the CPU determines whether the engine oil pressure abnormality flag is set OFF. If the engine oil pressure abnormality flag is set OFF, this means that the normal condition of the engine oil pressure is continued. Block 9200 is therefore brought to an end at once. If the engine oil pressure abnormality flag is not set OFF, i.e., if the engine oil pressure abnormality has occurred until the previous processing cycle, the process flow proceeds to STEP 9208.

Step 9208:

The engine oil pressure abnormality flag is set OFF.

Step 9209:

The current time is read from the RTC 4603.

Step 9210:

The clearance time of the engine oil pressure abnormality is stored in the EEPROM 4602 in the form of "year, month, day, hour, minute, and OFF" at a storage location in the EEPROM corresponding to the engine oil pressure abnormality as shown in FIG. 24. Block 9200 is then brought to an end.

As described above, the occurrence and clearance time of the engine oil pressure abnormality are successively stored in the EEPROM 4602, as shown in FIG. 24, upon each occurrence or clearance of the engine oil pressure abnormality.

Figure 26:
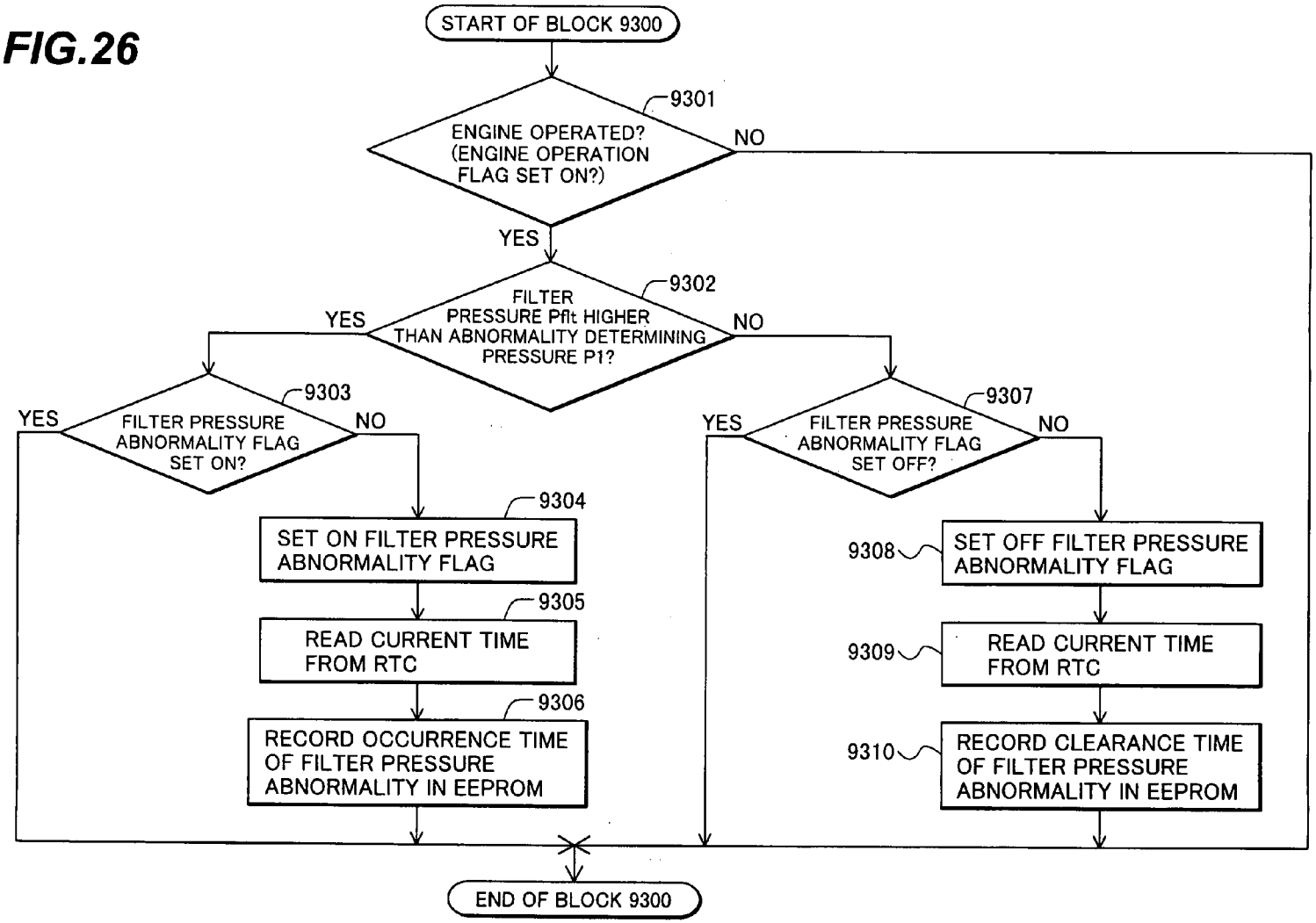
FIG. 26 is a flowchart for explaining details of a filter pressure abnormality recording process in the main process of the operating information monitor.

Subsequent to the completion of block 9200, block 9300 is executed. FIG. 26 is a flowchart showing detailed steps of block 9300. Block 9300 will be described below with reference to FIG. 26.

Step 9301:

First, whether the engine 14 is operated or not is determined by checking whether the engine operation flag is set ON. If the engine 14 is not operated (if the engine operation flag is set OFF), block 9300 is brought to an end. If the engine is operated, the process flow proceeds to STEP 9302.

Step 9302:

The CPU determines whether the filter pressure Pflt, which is directly received from the excavator body information monitor 45 via the specific standard communication line 39, is higher than an abnormality determining pressure P1. If so, this condition is determined to be abnormal and the process flow proceeds to STEP 9303. If the filter pressure Pflt is lower than the abnormality determining pressure P1, this condition is determined to be normal and the process flow proceeds to STEP 9307.

Step 9303:

If the filter pressure Pflt is determined to be abnormal in STEP 9302, the CPU determines whether the filter pressure abnormality flag at the current time is set ON. If the filter pressure abnormality flag is set ON, this means that the abnormal condition is continued. Therefore, block 9300 is brought to an end at once. If it is determined that the filter pressure abnormality flag is not set ON, i.e., the flag is set OFF, the process flow proceeds to STEP 9304.

Step 9304:

The filter pressure abnormality flag is set ON.

Step 9305:

The current time is read from the RTC 4603.

Step 9306:

The occurrence time of the filter pressure abnormality is stored in the EEPROM 4602 in the form of "year, month, day, hour, minute, and ON" at a storage location in the EEPROM corresponding to the filter pressure abnormality as shown in FIG. 24. Block 9300 is then brought to an end.

When the operating information monitor 46 is started up in this case, the filter pressure abnormality flag is set OFF in the initial value setting 9000. Accordingly, at a point in time when the filter pressure abnormality occurs for the first time after the startup, the processing is executed through STEP 9302-9303-9304-9305-9306, whereby the filter pressure abnormality flag is set ON.

Step 9307:

On the other hand, if it is determined in STEP 9302 that the engine oil pressure is not abnormal (i.e., Pflt<P1), the CPU determines whether the filter pressure abnormality flag is set OFF. If the filter pressure abnormality flag is set OFF, this means that the normal condition of the filter pressure is continued. Block 9300 is therefore brought to an end at once. If the filter pressure abnormality flag is not set OFF, i.e., if the filter pressure abnormality has occurred until the previous processing cycle, the process flow proceeds to STEP 9308.

Step 9308:

The filter pressure abnormality flag is set OFF.

Step 9309:

The current time is read from the RTC 4603.

Step 9310:

The clearance time of the filter pressure abnormality is stored in the EEPROM 4602 in the form of "year, month, day, hour, minute, and OFF" at a storage location in the EEPROM corresponding to the filter pressure abnormality as shown in FIG. 24. Block 9300 is then brought to an end.

As described above, the occurrence and clearance time of the filter pressure abnormality are successively stored in the EEPROM 4602, as shown in FIG. 24, upon each occurrence or clearance of the filter pressure abnormality.

Figure 27:
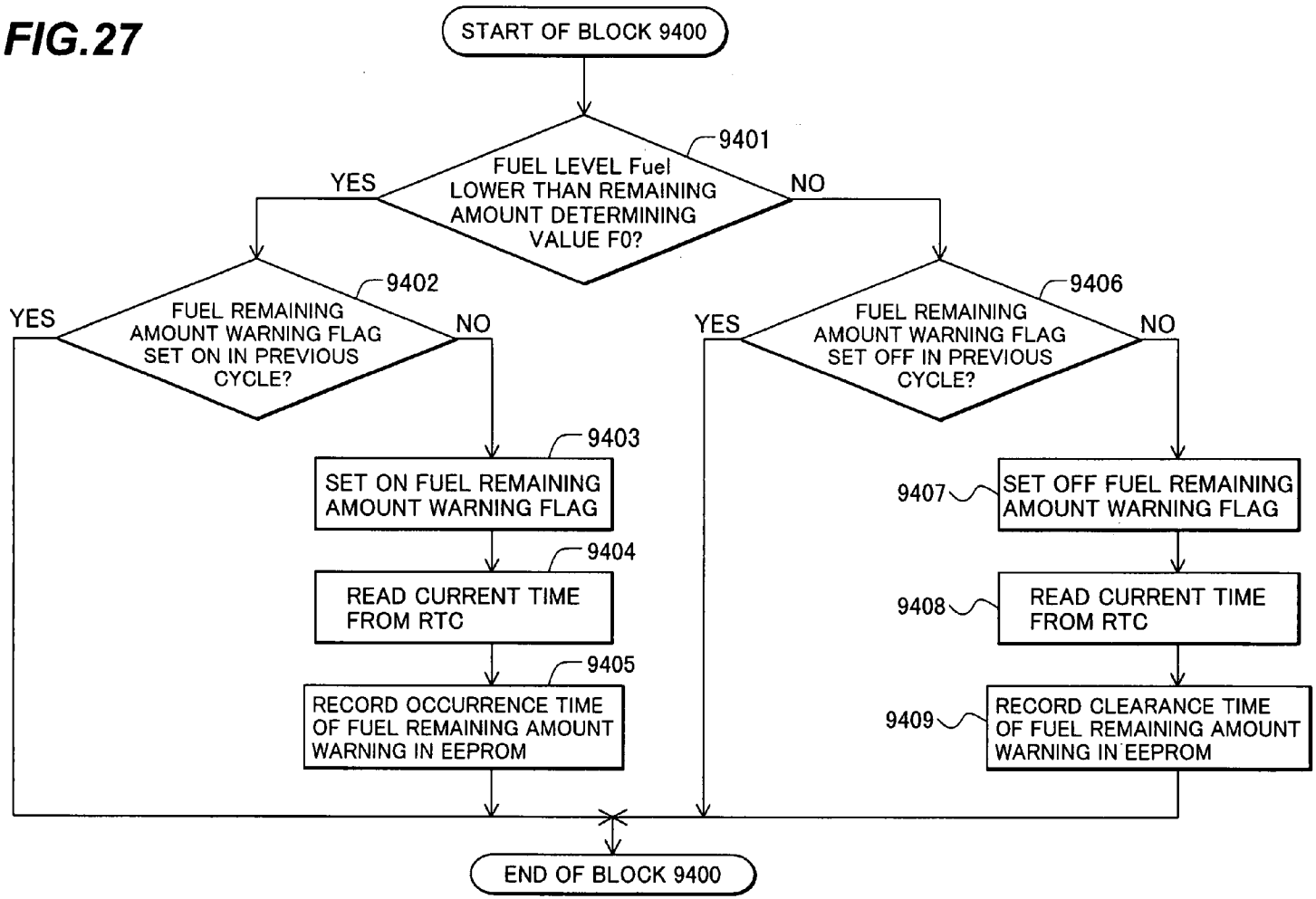
FIG. 27 is a flowchart for explaining details of a fuel remaining-amount warning recording process in the main process of the operating information monitor.

Subsequent to the completion of block 9300, block 9400 is executed. FIG. 27 is a flowchart showing detailed steps of block 9400. Block 9400 will be described below with reference to FIG. 27.

Step 9401:

The CPU determines whether the fuel level Fuel, which is directly received from the excavator body information monitor 45 via the specific standard communication line 39, is lower than an abnormality determining value F0. If so, this is determined as indicating a warning condition (deficient amount of the fuel) and the process flow proceeds to STEP 9402. If the fuel level Fuel is higher than the abnormality determining value F0, this condition is determined to be normal and the process flow proceeds to STEP 9406.

Step 9402:

If the warning condition (deficient amount of the fuel) is determined in STEP 9401, the CPU determines whether the fuel remaining amount warning flag at the current time is set ON. If the fuel remaining amount warning flag is set ON, this means that the warning condition is continued. Therefore, block 9400 is brought to an end at once. If it is determined that the fuel remaining amount warning flag is not set ON, i.e., the flag is set OFF, the process flow proceeds to STEP 9403.

Step 9403:

The fuel remaining amount warning flag is set ON.

Step 9404:

The current time is read from the RTC 4603.

Step 9405:

The occurrence time of the fuel remaining amount warning is stored in the EEPROM 4602 in the form of "year, month, day, hour, minute, and ON" at a storage location in the EEPROM corresponding to the fuel remaining amount warning as shown in FIG. 24. Block 9400 is then brought to an end.

When the operating information monitor 46 is started up in this case, the fuel remaining amount warning flag is set OFF in the initial value setting 9000. Accordingly, at a point in time when the fuel remaining amount warning occurs for the first time after the startup, the processing is executed through STEP 9401-9402-9403-9404-9405, whereby the fuel remaining amount warning flag is set ON.

Step 9406:

On the other hand, if it is determined in STEP 9401 that the fuel remaining amount is not deficient (i.e., Fuel>F0), the CPU determines whether the fuel remaining amount warning flag is set OFF. If the fuel remaining amount warning flag is set OFF, this means that the fuel remaining amount is continuously held in the normal condition, and therefore block 9400 is brought to an end at once. If the fuel remaining amount warning flag is not set OFF, i.e., if the fuel remaining amount warning has occurred until the previous processing cycle, the process flow proceeds to STEP 9407.

Step 9407:

The fuel remaining amount warning flag is set OFF.

Step 9408:

The current time is read from the RTC 4603.

Step 9409:

The clearance time of the fuel remaining amount warning is stored in the EEPROM 4602 in the form of "year, month, day, hour, minute, and OFF" at a storage location in the EEPROM corresponding to the fuel remaining amount warning as shown in FIG. 24. Block 9400 is then brought to an end.

As described above, the occurrence and clearance time of the fuel remaining amount warning are successively stored in the EEPROM 4602, as shown in FIG. 24, upon each occurrence or clearance of the fuel remaining amount warning.

Figure 28:
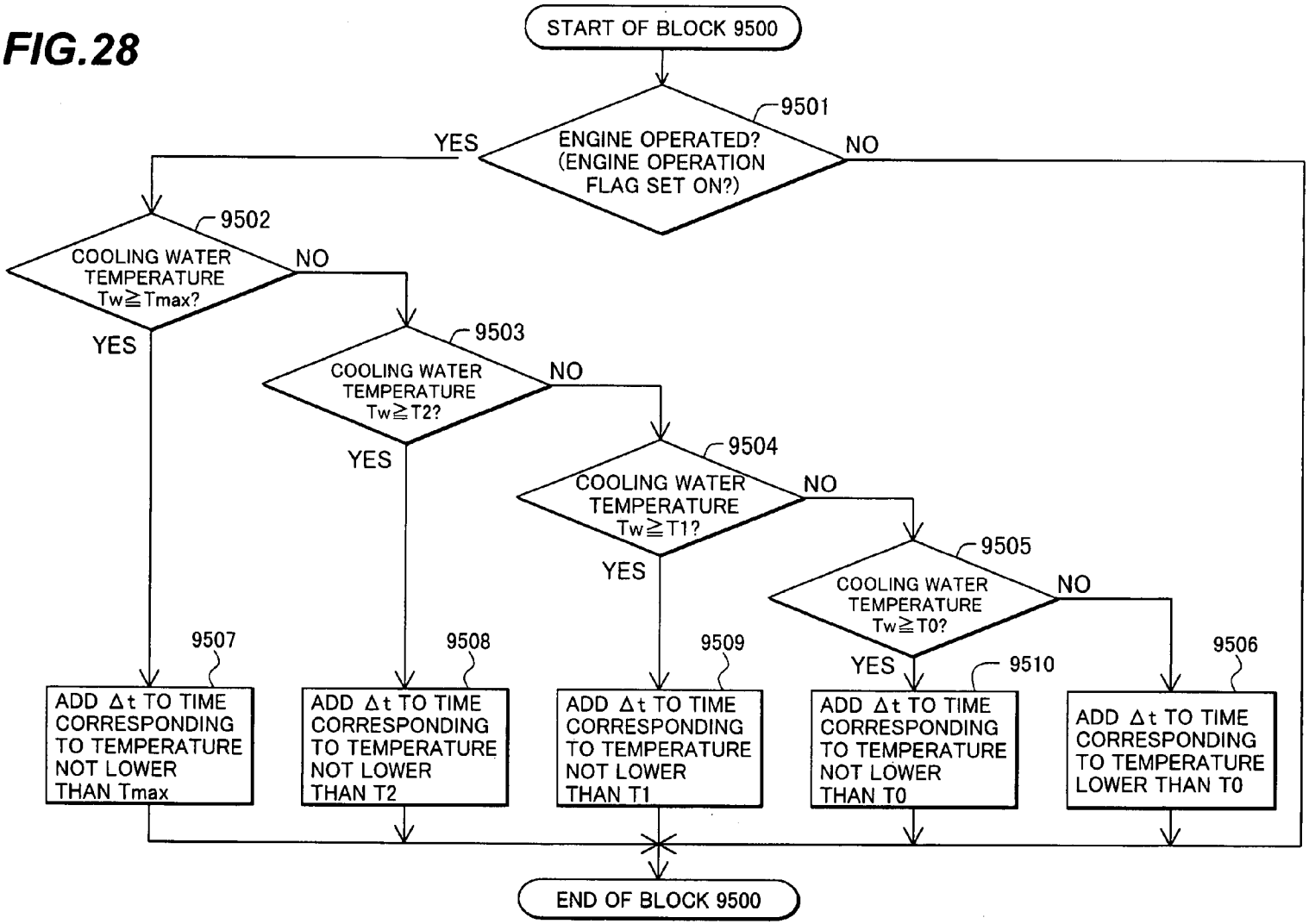
FIG. 28 is a flowchart for explaining details of a cooling-water-temperature frequency distribution recording process in the main process of the operating information monitor.

Subsequent to the completion of block 9400, block 9500 is executed. FIG. 28 is a flowchart showing detailed steps of block 9500. Block 9500 will be described below with reference to FIG. 28.

Step 9501:

First, whether the engine 14 is operated or not is determined by checking whether the engine operation flag is set ON. If the engine 14 is not operated (if the engine operation flag is set OFF), block 9500 is brought to an end. If the engine is operated, the process flow proceeds to STEP 9502.

Step 9502 to 9505:

The CPU determines whether the cooling water temperature Tw, which is received via the communication line 39 through the conversion made in the communication relay control unit 100, falls in which one of the following five regions:

(1) Tw≧Tmax
(2) Tmax>Tw≧T2
(3) T2>Tw≧T1
(4) T1>Tw≧T0
(5) T0>Tw Depending on a determination result, the process flow proceeds in accordance with one of the following five cases:

(1) if Tw≧Tmax . . . to STEP 9507
(2) if Tmax>Tw≧T2 . . . to STEP 9508
(3) if T2>Tw≧T1 . . . to STEP 9509
(4) if T1>Tw≧T0 . . . to STEP 9510
(5) if T0>Tw . . . to STEP 9506

Step 9506 to 9510:

As shown in the frequency distribution of the water temperature, the processing cycle Δt (in units of, e.g., mS) for each of blocks 9100 to 9600 executed by the monitor 46 is successively added at a corresponding storage location. For example, if the cooling water temperature Tw is determined to be not lower than Tmax in STEP 9502, the process flow proceeds to STEP 9507. Then, in STEP 9507, At is added to the time recorded as the frequency distribution of the water temperature in the EEPROM 4602 at a storage location for the region of Tw≧Tmax.

By continuing the above-described process, the time corresponding to each region of the cooling water temperature is accumulated and a frequency distribution of the cooling water temperature in terms of time is recorded in the storage location corresponding to the frequency distribution of the water temperature as shown in FIG. 24. In the example of FIG. 24, the frequency distribution of the water temperature is given as follows:

(1) Tw≧Tmax . . . 10 hr
(2) Tmax>Tw≧T2 . . . 190 hr
(3) T2>Tw≧T1 . . . 310 hr
(4) T1>Tw≧T0 . . . 520 hr
(5) T0>Tw . . . 220 hr It is thus understood that, of the accumulated engine operating time of 1250 hr, 520 hr falls in the range of T1>Tw≧T0.

The determining values Tmax, T2, T1 and T0 used in the above-mentioned process may be set for each model of the excavator body. Those values can be set, by way of example, such that Tmax is the overheat temperature in design, T0 is the freezing point of 0° C., and the other values are decided as values resulting from dividing the range from Tmax to T0 into equal intervals.

Block 9500 is then brought to an end.

After the completion of block 9500, the process flow proceeds to block 9600. Block 9600 represents a process for outputting the information recorded in the EEPROM 4602 through blocks 9100 to 9500 to the personal computer (PC) 53 connected to the monitor 46. The PC 53 is not connected to the monitor 46 at all times, and it is connected to a terminal of the communication section 4601 of the monitor 46 when a serviceman is going to perform maintenance of the excavator body, so that the information is outputted to the PC 53.

Figure 29:
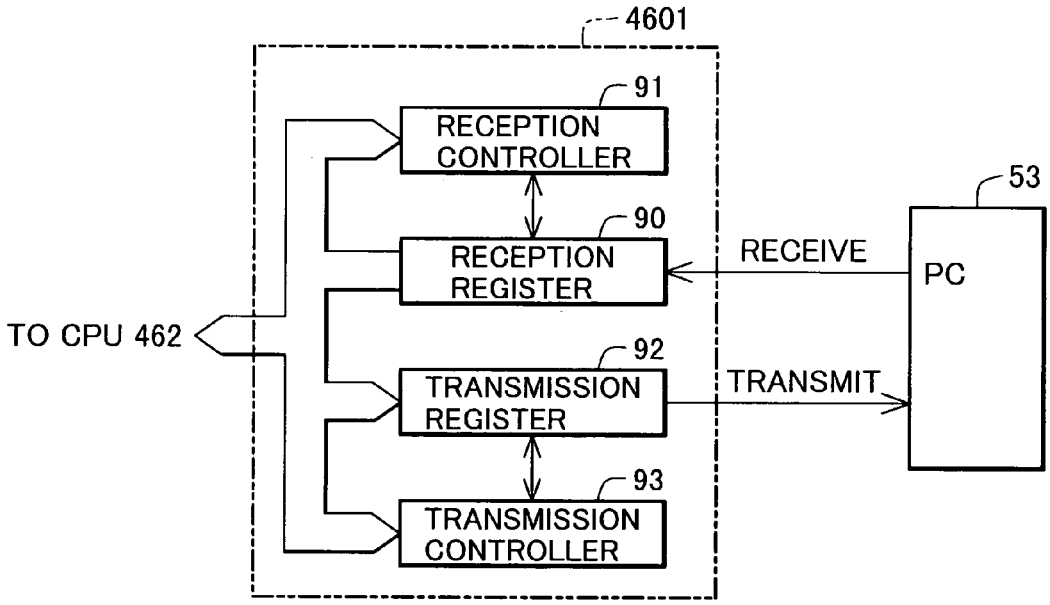
FIG. 29 is a functional block diagram showing a functional configuration of a third communication control section.

FIG. 29 is a functional block diagram showing an internal configuration of the external communication control section 4601 of the operating information monitor 46. In FIG. 29, upon receiving data in the form of a serial signal from the PC 53, the external communication control section 4601 converts the received data into digital data and stores the digital data in a reception register 90. When the data is inputted to the reception register 90, a reception end flag is set in a reception controller 91. The CPU 462 is able to confirm the inputting of data by monitoring the reception end flag. Also, when the CPU 462 transmits data to the PC 53, the CPU monitors whether a transmission flag indicating a vacant state of a transmission register in the transmission controller 93 indicates the vacant state (i.e., whether the flag is set). If it is determined that the transmission flag is set, the CPU 462 is allowed to write digital transmission data in the transmission register 92. When the digital data is written in the transmission register 92, the external communication control section 4601 automatically converts the digital data into serial data and transmits the serial data to the PC 53. The data is in the form of character code, for example, and an instruction (command) or a numerical value is received and transmitted in the form of character code.

Figure 30:
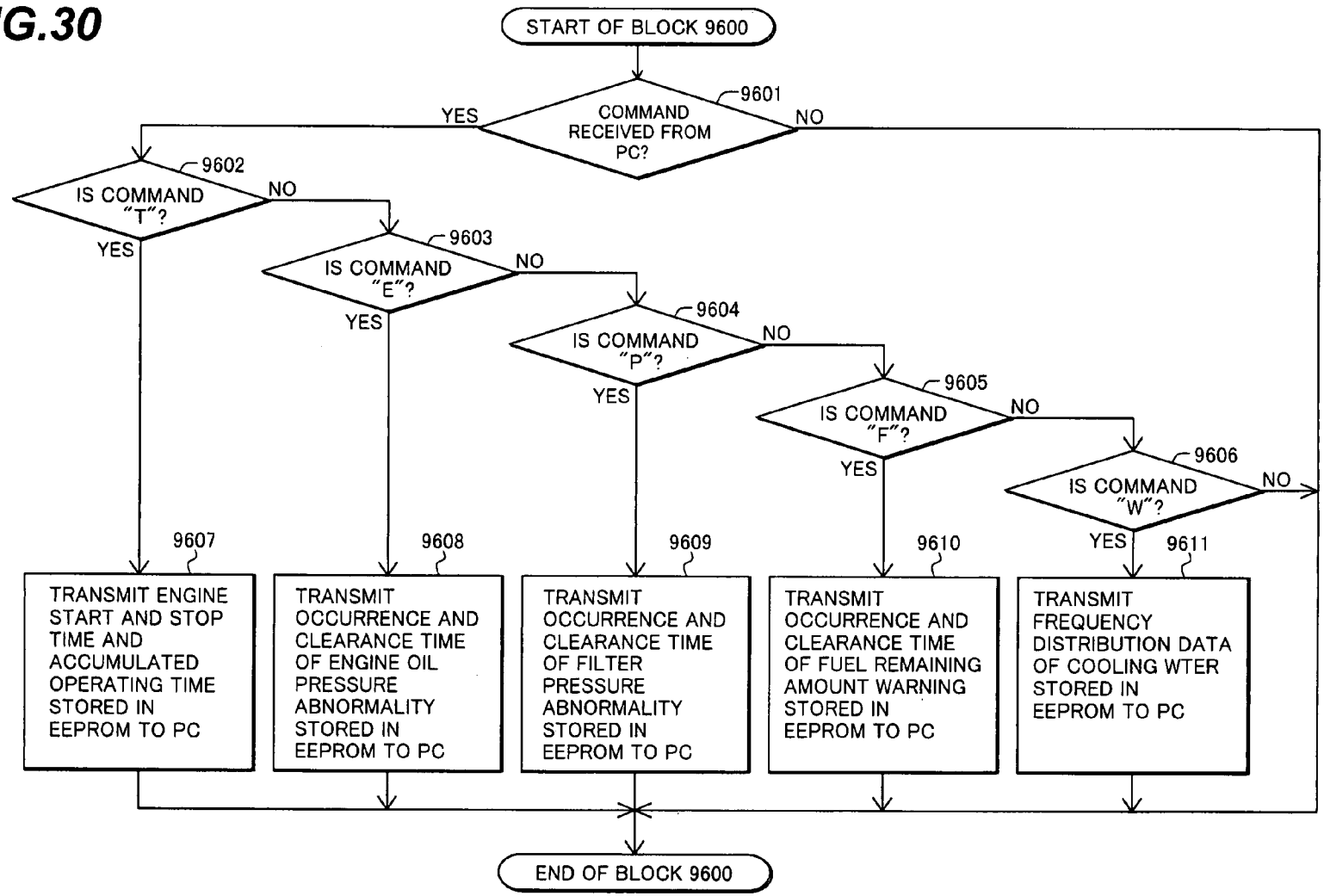
FIG. 30 is a flowchart for explaining details of a PC communication process in the main process of the operating information monitor.

The communication with respect to the PC 53 is carried out by utilizing the above-described function of the external communication control section 4601. FIG. 30 is a flowchart showing processing steps executed by the external communication control section 4601.

Step 9601:

First, whether a command (character code) is received from the PC 53 or not is determined by checking the reception flag in the external communication control section 4601. If no commands are received, block 9600 is brought to an end. If any command is received, the process flow proceeds to STEP 9602 and subsequent steps.

Step 9602 to 9606:

The CPU interprets the received character as a command. Depending on the interpreted command, the process flow proceeds as follows.

(1) Step 9602:

When the command (character code) is "T". . . to STEP 9607

(2) Step 9603:

When the command (character code) is "E". . . to STEP 9608

(3) Step 9604:

When the command (character code) is "P". . . to STEP 9609

(4) Step 9605:

When the command (character code) is "F". . . to STEP 9610

(5) Step 9606:

When the command (character code) is "W". . . to STEP 9611

(6) Step 9606:

When the command (character code) is other than "W"block 9600 is brought to an end Step 9607 to 9611:

After the determination of the command, the record data in the EEPROM 4602, shown in FIG. 24, is outputted to the PC 53 in STEP 9607 to 9611. A data outputting manner is executed, by way of example, as follows. The contents of the recorded data are converted into a string of character code, and the string of character code is sent to the transmission register 92 on the character-by-character basis while confirming the state of the transmission flag in the transmission controller 93 of the external communication control section 4601. The transmission register 92 converts the string of character code into serial data and then sends the serial data to the PC 53. As an alternative, the recorded data may be transmitted in the form of numerical values without being converted into a string of character codes.

If the command is determined to be, e.g., "T" in STEP 9602, the start and stop time and the accumulated operating time of the engine are transmitted in STEP 9607 from the engine operation record in the EEPROM to the PC 53.

The PC 53 also includes a communication section similar to the external communication control section 4601 and reads data with similar processing to that described above.

Block 9600 is then brought to an end.

After the completion of block 9600, the process flow returns to block 9100. The monitor 46 repeatedly executes the processing of block 9100 to 9600. The time interval at which the processing is repeated defines the processing cycle At described above in connection with the frequency distribution of the water temperature.

In the construction described above, the excavation operating device 7, the upper swing structure 3, and the lower travel structure 2 constitute working devices set forth in each claim. The prime mover 14, the hydraulic pump 18, the hydraulic cylinders 11, 12 and 13, etc. constitute hydraulic equipment.

Further, the governor control unit 17 constitutes a primer mover control unit for controlling a prime mover, and also constitutes a particular one of a plurality of control units. The excavator body control unit 23 and the electric lever control unit 33 constitute a hydraulic equipment control unit for controlling the hydraulic equipment, and also constitute one of the plurality of control units other than the particular control unit.

Moreover, the common standard communication line 40 constitutes a universal communication line that is connected to the particular one of the plurality of control units and is adapted for an interface in accordance with universal communication standards. The specific standard communication line 39 constitutes a dedicate standard communication line that is connected to the one of the plurality of control units other than the particular control unit and is adapted for an interface in accordance with dedicated communication standards other than the universal communication standards.

Additionally, STEP 1702, STEP 2302, and STEP 4501 executed by the control units 17, 23 and the monitors 45, 46 constitute collecting means for collecting detected signals from sensors. STEP 9100 to 9500 constitute information creating means for creating operating information data or failure information data of each component of a construction machine based on the detected signals collected.

This embodiment thus constructed has the following advantages.

(1) Adaptability for Recent Construction Machine in Conformity With Universal Communication Standards In the present invention, as described above, the governor control unit 17 is connected to the communication line 40 adapted for the interface in conformity with the universal communication-standards (common communication standards), while the other control units 23, 33 and the monitors 45, 46 are connected to the communication line 39 adapted for the interface in conformity with the dedicated communication standards (specific communication standards) different from the universal communication standards. Then, the communication relay control unit 100 is provided for mutual data communication between both the communication lines 39 and 40 having the different standards from each other. With the function of the communication relay control unit 100, communication data received from one of the two communication lines is transmitted to the other communication line after conversion to be adapted for the communication standards of the other communication line.

With the provision of two systems of the communication lines 39, 40, the side of the governor control unit 17 can be constructed using an interface in conformity with the universal communication standards adopted in the automobile industry as conventional, whereas the side of the communication line 39 connected to the other control units 23, 33 can be constructed in conformity with specific dedicated communication standards without undergoing restrictions imposed from using the universal communication standards, whereby the contents of communication data, the communication cycle, etc., which are optimum for, e.g., control and collection of information of the construction machine, can be employed based on specific definition. As a result, this embodiment can develop a satisfactory electronic control function even when the present invention is applied to the recent construction machine having the interface in conformity the universal communication standards.

(2) Cost Reduction

Since a communication system is divided into the two communication lines 39, 40, the amount of communication data and the communication frequency are distributed to the two communication lines 39, 40. Therefore, a communication line and a processing unit capable of operating at extremely high speeds are no longer required, and a cost reduction can be achieved while preventing machine components from becoming more complicated.

(3) Extensibility as System

With the division into the two communication lines 39, 40, a flexible system having superior extensibility can be constructed in which, for example, even when a new control unit is added to one of the two communication lines for expansion of the function, the amount of communication data and the communication frequency in the other communication line are not affected. In particular, since specific communication data can be defined, as required, on the side of the specific standard communication line 39 as described above, it is possible to improve extensibility as a system of the construction machine.

Figure 31:
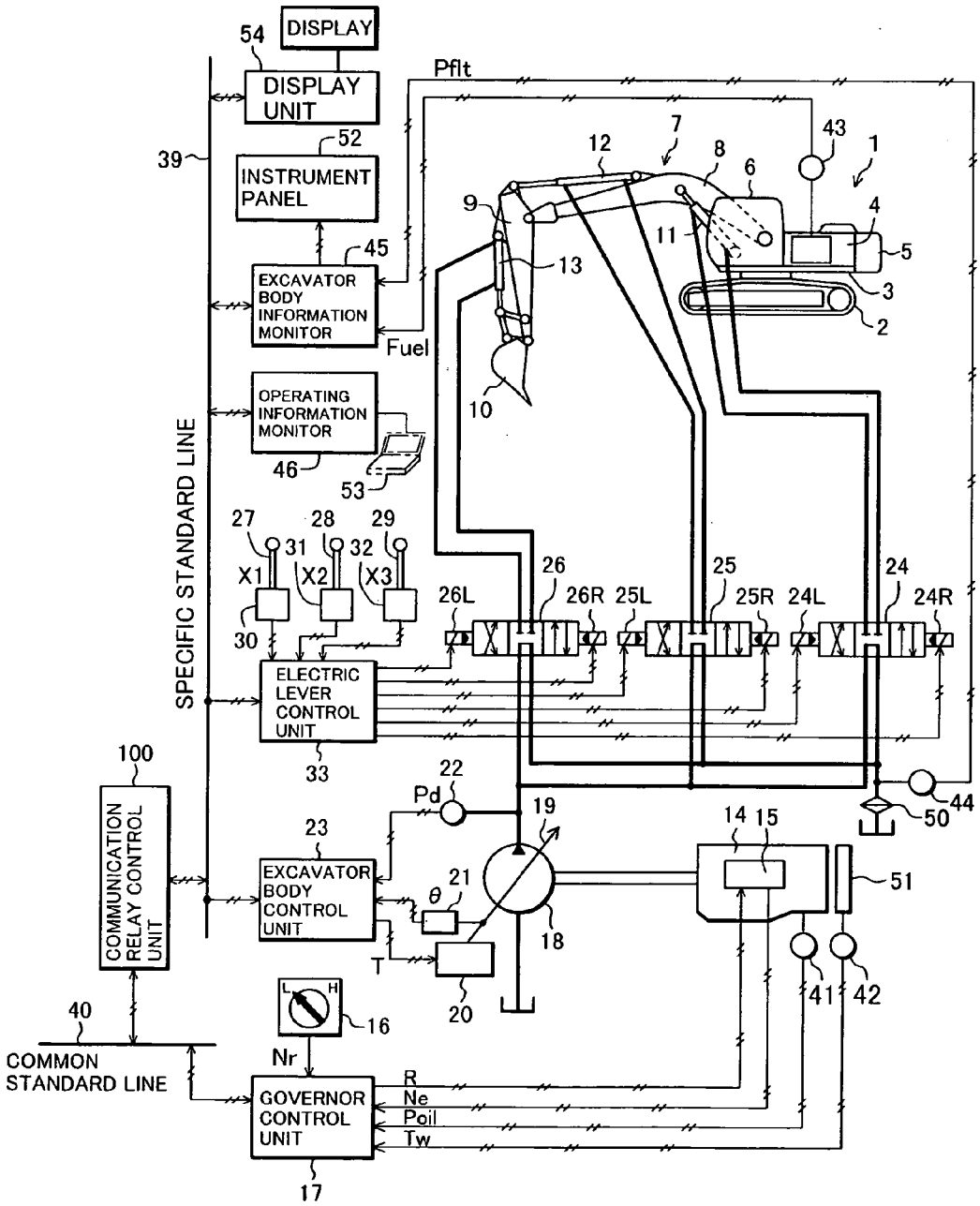
FIG. 31 shows a modification in which a display unit for the construction machine is connected to a specific standard communication line.

For instance, when adding, as one control device specific to the construction machine, a multi-function display unit 54 for providing, to an operator, the information managed by and recorded in the excavator body information monitor 45 and the operating information monitor 46, the display unit 54 requires to be just connected, as it is, to the specific standard communication line 39 shown, by way of example, in FIG. 31 because that type of the display unit 54 for the construction machine usually has an interface in conformity with the specific communication standards. This modification can provide an advantage that the number of steps necessary for adding the function can be reduced.

Figure 32:
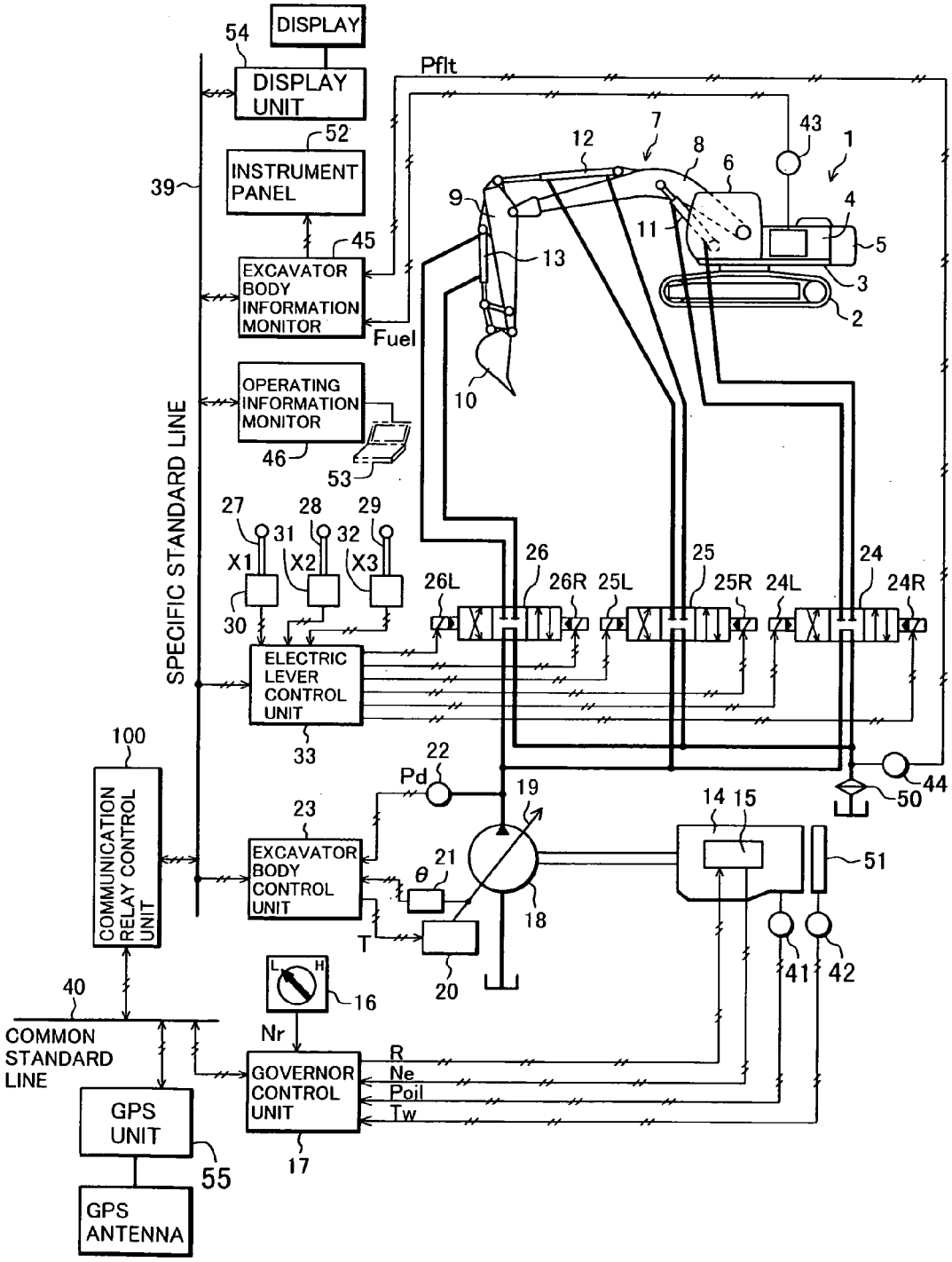
FIG. 32 shows a modification in which a universal GPS unit is connected to the common standard communication line.

On the other hand, in the case of trying to record position information of the hydraulic excavator body in the operating information monitor 46 by using, e.g., a GPS unit on the side of the common standard communication line 40, it is just required to connect a universal GPS unit 55, which has an interface in conformity with the common communication standards, to the common standard communication line 40 as shown in FIG. 32, and to modify software such that the position information can be processed in the communication relay control unit 100 and the operating information monitor 46. Accordingly, superior extensibility can be obtained on the universal standard side as well. As a matter of course, this modification can also reduce the number of steps necessary for adding the function.

(4) Following Capability to Model Change, etc.

Further, in some cases, the interface in conformity with the universal communication standards, which has been so far equipped in the construction machine, is replaced by another interface in conformity with different communication standards, or the universal communication standards are modified themselves for the reason of, e.g., model change of the prime mover 14. When such a modification is required in a communication system in which all control units have interfaces in conformity with the same communication standards as proposed in, for example, the above-cited JP,B 8-28911, not only the interfaces of the prime mover control unit, but also the interfaces of all other control units must be modified, thus resulting in disadvantages such as a reduction of the development efficiency and an increase of the development cost. In contrast, according to this embodiment, since the communication system is divided into two lines described above, i.e., the communication line 40 in conformity with the common communication standards and the communication line 39 in conformity with the specific communication standards, no effects are imposed on the side of the communication line 39 in conformity with the specific communication standards even in the case in which, for example, the communication standards are modified as mentioned above. As a result, changes required in software and hardware of the control units depending on modification of the communication standards can be minimized.

A second embodiment of the present invention will be described with reference to FIGS. 33 to 36. This embodiment represents the case in which an electronic control system includes a communication management control unit 100' having the function of managing communication data from various control units and monitors in a centralized manner. Note that identical components to those in the first embodiment are denoted by the same characters and a description thereof is omitted unless especially necessitated.

Figure 33:
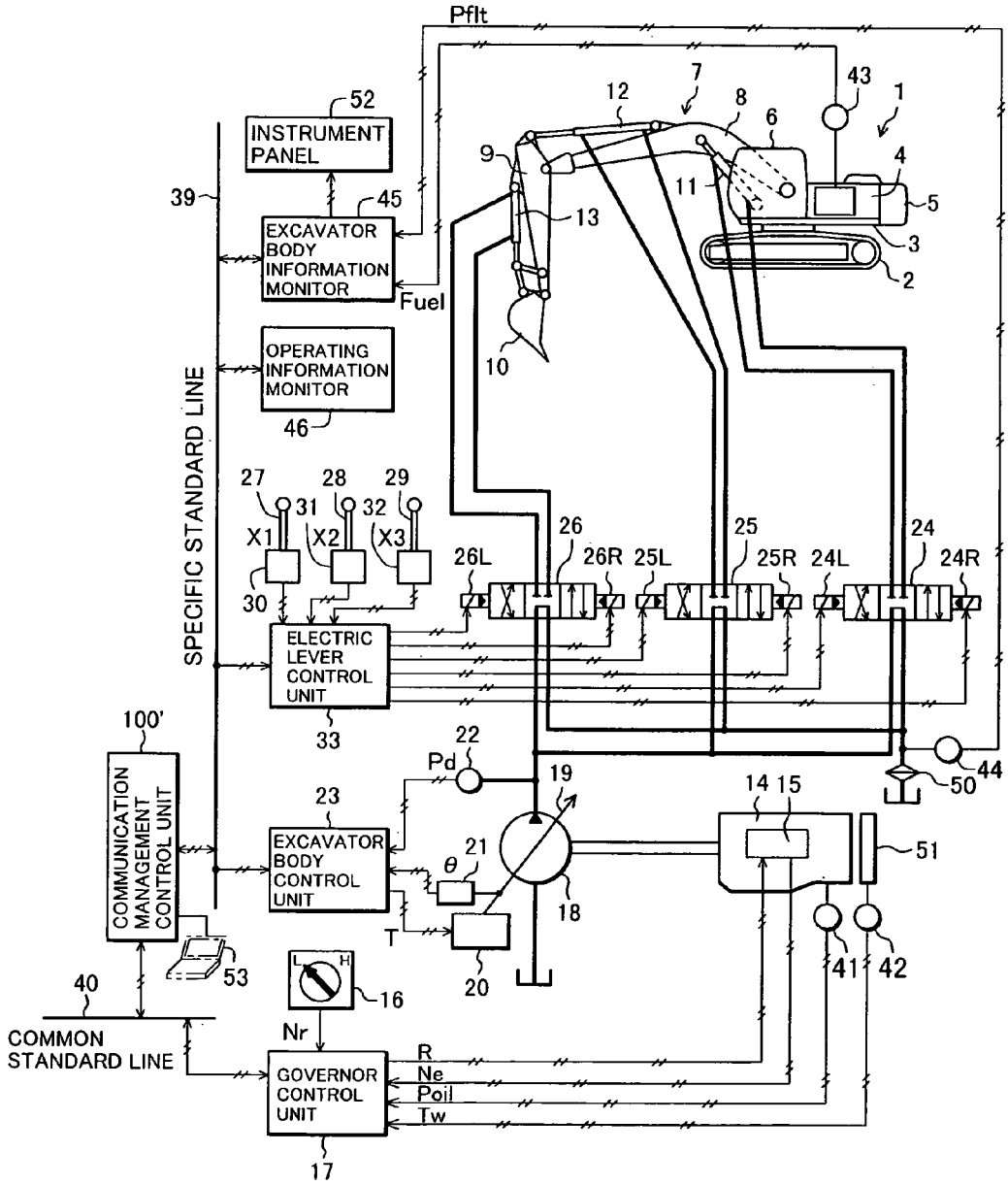
FIG. 33 is a block diagram of an electronic control system for a hydraulic excavator according to a second embodiment of the present invention, the diagram also illustrating the hydraulic excavator and a hydraulic system equipped in the hydraulic excavator.

FIG. 33 is a block diagram of an electronic control system for a hydraulic excavator according to a second embodiment of the present invention, the diagram also illustrating the hydraulic excavator and a hydraulic system equipped in the hydraulic excavator. FIG. 33 corresponds to FIG. 1 representing the first embodiment. Referring to FIG. 33, in this second embodiment, a database (described later) is prepared in the communication relay control unit 100 used in the first embodiment to constitute the communication management control unit 100' having the function of managing communication data from various control units and monitors in a centralized manner.

Figure 34:
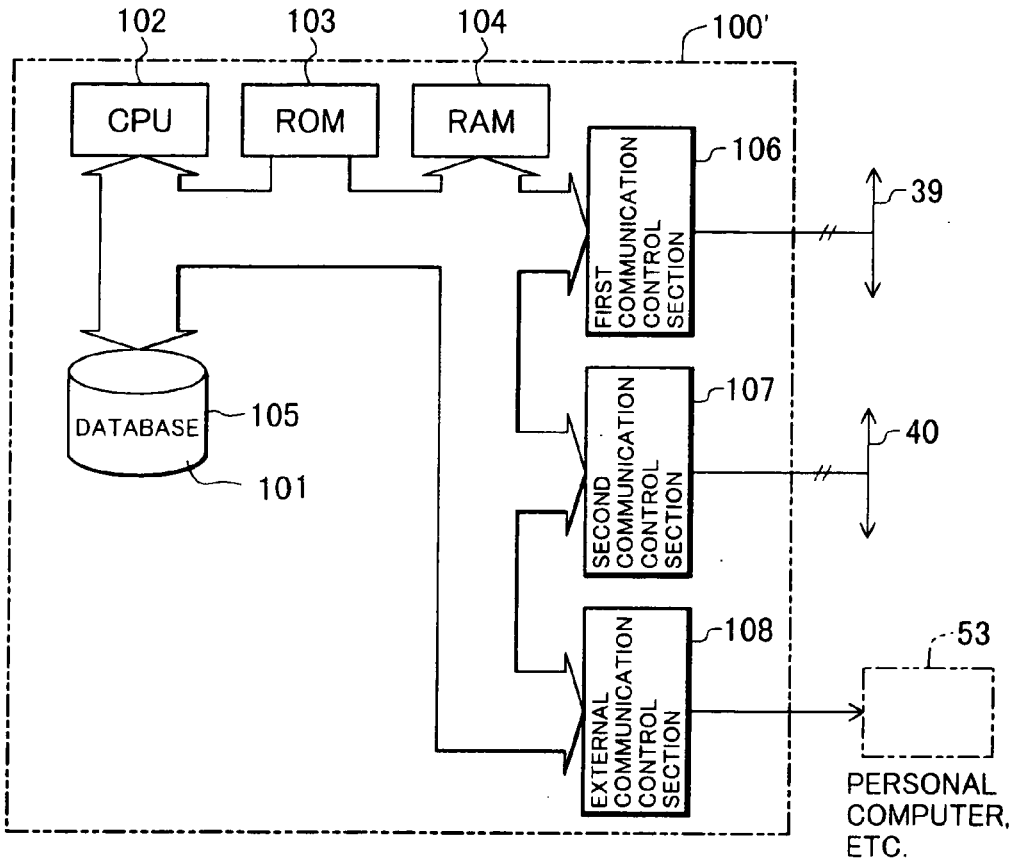
FIG. 34 is a functional block diagram showing a functional configuration of a communication management control unit shown in FIG. 33.

FIG. 34 is a functional block diagram showing a functional configuration of the communication management control unit 100'. Referring to FIG. 34, the communication management control unit 100' differs from the communication relay control unit 100 shown in FIG. 7 in that a main storage unit 105 is provided which includes a database 101 for storing not only communication data from the governor control unit 17, etc. for receiving the data via the common standard communication line 40 similarly to the first embodiment, but also communication data from the control units 23, 33 and the monitors 45, 46 for receiving the data via the specific standard communication line 39, and that an external communication control section 108 is provided which has substantially the same function as that of the external communication control section 4601 of the operating information monitor 46 shown in FIG. 6. By employing such an arrangement, the communication management control unit 100' is able to have a centralized management function for all of communication data flowing through both the common standard communication line 40 and the specific standard communication line 39.

In this embodiment, though not described here in more detail, communication control sections 107 and 106 of the communication management control unit 100' always monitor communication data packets flowing over the common standard communication line 40 and communication data packets flowing over the specific standard communication line 39, thereby obtaining all of those communication data packets. Then, the communication management control unit 100' extracts data from the obtained data packets in accordance with respective formats of the communication standards, and stores all of the extracted data successively in the database 101 in the format without depending on the communication standards.

Subsequently, a transmission request for data among the stored data, which is to be received by any of the control units 17, 23, 33 or the monitors 45, 46, is sent to the communication control section 107 or 106 via the communication line 39 or 40. Responsively, the CPU 102 executes data conversion to be adapted for the communication standards on the side having requested the transmission of the data, and then transmits the converted data from the communication control section 106 or 107 via the communication line 40 or 39.

As one example, the case of storing the engine oil pressure Poil transmitted form the governor control unit 17 in the database 101 and receiving the stored data by the operating information monitor 46 after data conversion will be described with reference to FIGS. 35 and 36.

Figure 35:
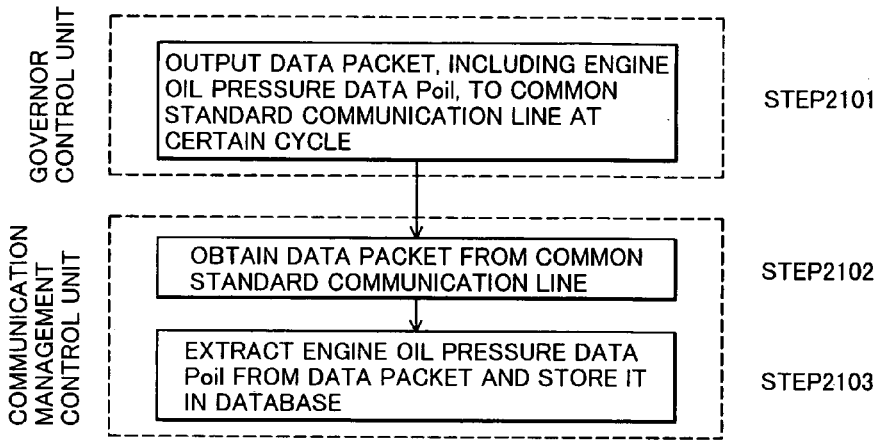
FIG. 35 schematically shows processing procedures of data communication between the governor control unit and the communication management control unit.

FIG. 35 schematically shows processing procedures of data communication between the governor control unit 17 and the communication management control unit 100'. FIG. 36 schematically shows processing procedures of data communication between the communication management control unit 100' and the operating information monitor 46.

Referring to FIG. 35, the governor control unit 17 first outputs a data packet including the engine oil pressure data Poil to the common standard communication line 40 at a predetermined cycle (STEP 2101).

Correspondingly, the communication management control unit 100' obtains the data packet including the engine oil pressure data Poil from the common standard communication line 40 (STEP 2102), extracts the engine oil pressure data Poil from the obtained data packet, and then stores the extracted data in the database 101 (STEP 2103).

Figure 36:
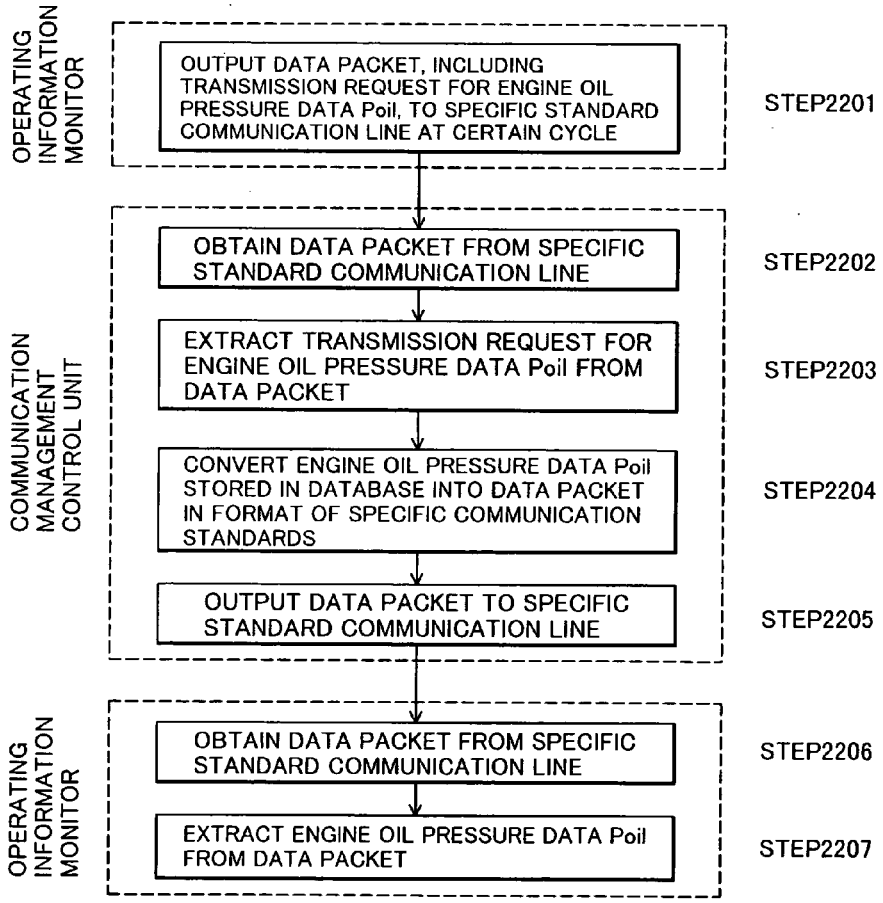
FIG. 36 schematically shows processing procedures of data communication between the communication management control unit and the operating information monitor.

Next, referring to FIG. 36, the operating information monitor 46 outputs a data packet including a transmission request for the engine oil pressure data Poil to the specific standard communication line 39 at a predetermined cycle (STEP 2201).

Correspondingly, the communication management control unit 100' obtains the data packet including the transmission request for the engine oil pressure data Poil from the specific standard communication line 39 (STEP 2202), and extracts the transmission request for the engine oil pressure data Poil from the obtained data packet (STEP 2203). Thereafter, the data of the engine oil pressure Poil stored in the database 101 in STEP 2103 is converted into a format in accordance with the specific communication standards to prepare a data packet adapted for that format (STEP 2204). Then, the communication management control unit 100' outputs the converted data packet including the engine oil pressure data Poil to the specific standard communication line 39 (STEP 2205).

Correspondingly, the operating information monitor 46 obtains the data packet including the engine oil pressure data Poil from the specific standard communication line 39 (STEP 2206), and then extracts the engine oil pressure data Poil from the obtained data packet (STEP 2207).

In such a way, all data flowing over the specific standard communication line 39 and the common standard communication line 40 are temporarily stored and accumulated in the database 101 inside the communication management control unit 100'. Thereafter, the stored data is converted into the communication standard format adapted for the transmitting side in response to the transmission request from any of the control units 17, 23, 33 and the monitors 45, 46, and the converted data is set to the corresponding communication line 39 or 40.

In the construction described above, STEP 2102 and STEP 2103, shown in FIG. 35, executed by the communication management control unit 100' constitute storage means, set forth in claim 2, for temporarily storing communication data received from two systems of communication lines. STEP 2204 and STEP 2205 constitute conversion means for, when a transmission request for communication data received from one of the two systems of communication lines and stored in the storage means is received via the other communication line, converting the stored communication data to be adapted for the communication standards of the other communication line and outputting the converted data.

This second embodiment can provide the following advantages in addition to the same advantages as those obtained with the first embodiment.

The communication management control unit 100' is able to, as described above, store all communication data transmitted from the plurality of control units 17, 23, 33 and monitors 45, 46, etc. together and manage the data in a centralized manner. Accordingly, as described above with reference to FIGS. 35 and 36, the processing on the data transmitting side and the processing on the data receiving side can be handled independently of each other through the communication management control unit 100'. More specifically, the data transmitting side is just required to transmit data to the communication management control unit within the ordinary control cycle set for the data transmitting side itself (see STEP 2101 to STEP 2103 in FIG. 35). The data receiving side is just required to transmit a data transmission request to the communication management control unit within the ordinary control cycle set for the data receiving side itself and to receive data from the communication management control unit (see STEP 2201 to STEP 2203 in FIG. 35). As a result, the number of processing steps in the control units 17, 23, 33 and the monitors 45, 46 can be reduced, and the data transmitting side is no longer required, for example, to transmit data in response to an interrupt of a data transmission request from the data receiving side (see the example described above in the first embodiment, (2) Transmission and Reception in Response to Transmission Request Command in connection with the engine oil pressure Poil or the engine cooling water temperature Tw). It is therefore possible to prevent a reduction of the processing efficiency which is otherwise caused with the occurrence of the transmission request interrupt. Further, on the data receiving side, a delay time from transmission of the data transmission request to actual sending of data can be cut down, and a reduction of the processing efficiency can be prevented which is otherwise caused with the necessity of waiting for arrival of the communication data. As a result the communication processing load and the control processing load imposed on the control units 17, 23, 33 and the monitors 45, 46 can be greatly reduced.

Additionally, in the first embodiment described above, the operating time, the operating condition, etc. of the hydraulic excavator 1 are stored through the steps of receiving, by the operating information monitor 46, the signals outputted from the excavator body information monitor 45 and the governor control unit 17 via the communication lines 39, 40 and executing the predetermined processing on the received signals in the monitor 46. When it is desired to collect operating information data and failure information data during maintenance, a maintenance worker connects an external device, such as a personal computer (PC) 53, to the monitor 46 so that the operating information data and the failure information data are outputted from the monitor 46. Thus, in the first embodiment, those data must be outputted after being temporarily taken and stored in the monitor 46, and other data and information than those not taken in the monitor 46 must be collected, for example, by additionally providing an interface for connection to an information terminal for each of the control units 17, 23, 33 and the monitor 45 and connecting the personal computer 53 or the like to them individually.

In contrast, according to this second embodiment, since the communication management control unit 100' manages all data using the database 101 in a centralized manner as described above, it is just required to read the information stored in the database 101 together by connecting the personal computer 53 or the like to the external communication control section 108 of the communication management control unit 100', as mentioned above, without the necessity of troublesome operations in taking out data to the exterior (see the personal computer 53 indicated by a two-dot-chain line in FIGS. 33 and 34). Consequently, it is possible to realize substantial labor savings in maintenance works and to eliminate the necessity of providing the interface for connection to the information terminal for each of the control units, thus resulting in a reduction of the cost.

In the first and second embodiments described above, two systems of common communication lines, i.e., the communication line 39 in conformity with the specific communication standards and the communication line 40 in conformity with the common communication standards, are provided as common buses for data communication. However, when the amount of control data or monitor data is increased, the number of the communication line 39 or the communication line 40 may be increased so as to provide three or more systems of common communication lines. Also, two types of data, i.e., control data and monitor data, have been described as types of communication data. In a hydraulic excavator equipped with an audio unit and other auxiliary equipment, however, audio data and switch system data for use therein may be communicated using the common standard communication line 40.

Further, while the above description has been made in connection with a hydraulic excavator as one example of construction machines, the present invention is not limited to such an application. The present invention is also applicable to other kinds of construction machines, e.g., a crawler crane and a wheel loader, so long as they are operated by using manual control levers. Similar advantages to those described above can also be obtained in such a case.

INDUSTRIAL APPLICABILITY

According to the invention set forth in claim 1, because of employing a two-system construction made up of a universal communication line and a dedicated communication line, the side of the prime mover control unit can be constructed using an interface in conformity with the universal communication standards adopted in, for example, the automobile industry as conventional. On the other hand, the side of the dedicated communication line associated with hydraulic equipment control units, etc. other than the prime mover control unit can be constructed in conformity with specific dedicated communication standards without undergoing restrictions imposed from using the universal communication standards, whereby the contents of communication data, the communication cycle, etc., which are optimum for, e.g., control and collection of information of the construction machine, can be employed based on specific definition. As a result, a satisfactory electronic control function can be developed even when the present invention is applied to the recent construction machine having the interface in conformity with the universal communication standards.

According to the invention set forth in claim 2, the communication management control unit 1001 is able to store all communication data from a plurality of control units and monitors, etc. together and to manage the data in a centralized manner. Consequently, processing on the data transmitting side and processing on the data receiving side can be handled independently of each other through the communication management control unit 100', and hence the communication processing load and the control processing load imposed on each of the control units can be greatly reduced.

The invention claimed is:

1. An electronic control system for a construction machine, which is equipped in a construction machine comprising a prime mover, a plurality of working devices, and plural pieces of hydraulic equipment generating hydraulic power based on driving forces of said prime mover and driving said working devices, said electronic control system having a plurality of control units including a prime mover control unit for controlling said prime mover and a plurality of hydraulic equipment control units for controlling said hydraulic equipment, said plurality of control units being interconnected for transmission and reception of data, said electronic control system further comprising:

a universal communication line provided as a common bus for data communication, said universal communication line being connected to said prime mover control unit and adapted for an interface in conformity with universal communication standards, said universal communication line enabling transmission and reception of data directly between said prime mover control unit and another control unit when said another control unit is connected to said universal communication line;

a dedicated communication line provided as a common bus for data communication, said dedicated communication line being connected to said plurality of hydraulic control units and adapted for an interface in conformity with dedicated communication standards different from the universal communication standards, said dedicated communication line enabling transmission and reception of data directly between said plurality of hydraulic equipment control units; and a communication relay control unit connected to said universal communication line and said dedicated communication line, converting communication data received from one of two systems of said communication lines to be in conformity with the communication standards of the other communication line, and transmitting converted data to the other communication line;

said prime mover control unit and said plurality of hydraulic equipment control units having a function to transmit data at a predetermined cycle set for each data; and said communication relay control unit maintaining said predetermined cycle regardless of the communication standards of the other communication line and transmitting the communication data at that maintained cycle to the other communication line when converting the communication data received from one of two systems of said communication lines to be in conformity with the communication standards of the other communication line, and transmitting the converted data to the other communication line.

2. An electronic control system for a construction machine according to claim 1, wherein said plurality of control units includes both of said prime mover control unit and said hydraulic equipment control units, said universal communication line is connected to said prime mover control unit, and said dedicated communication line is connected to said hydraulic equipment control units.

3. An electronic control system for a construction machine according to claim 1, further comprising at least one monitor connected to said dedicated communication line and monitoring operating status of said construction machine.

4. An electronic control system for a construction machine according to claim 1, further comprising a plurality of sensors for detecting status variables related to operating status of said construction machine, and at least one of said control units or said monitors includes collection means for collecting detected signals from said sensor.

5. An electronic control system for a construction machine according to claim 4, wherein said control units or said monitors for collecting the detected signals include information creating means for creating operating information data or failure information data for each of components of said construction machine based on the detected signals collected.

6. An electronic control system for a construction machine, which is equipped in a construction machine comprising a prime mover, a plurality of working devices, and plural pieces of hydraulic equipment generating hydraulic power based on driving forces of said prime mover and driving said working devices, said electronic control system having a plurality of control units including a prime mover control unit for controlling said prime mover and a plurality of hydraulic equipment control units for controlling said hydraulic equipment, said plurality of control units being interconnected for transmission and reception of data, said electronic control system further comprising:

a universal communication line provided as a common bus for data communication, said universal communication line being connected to said prime mover control unit and adapted for an interface in conformity with universal communication standards, said universal communication line enabling transmission and reception of data directly between said prime mover control unit and another control unit when said another control unit is connected to said universal communication line;

a dedicated communication line provided as a common bus for data communication, said dedicated communication line being connected to said plurality of hydraulic equipment control units and adapted for an interface in conformity with dedicated communication standards different from the universal communication standards, said dedicated communication line enabling transmission and reception of data directly between said plurality of hydraulic equipment control units; and a communication management control unit connected to said universal communication line and said dedicated communication line, and comprising storage means for temporarily storing communication data received from two systems of said communication lines, and conversion means for, when a transmission request for communication data received from one of the two systems of-one-of said communication lines and stored in the storage means is received via the other of said communication lines, converting the stored communication data to be adapted for the communication standards of the other communication line and outputting the converted data; and said prime mover control unit and said plurality of hydraulic equipment control units having a first communication function to transmit data at a predetermined cycle set for each data and a second communication function to transmit said transmission request for communication data at a predetermined cycle, whereby the data transmitting side of said prime mover control unit and said plurality of hydraulic equipment control units transmit data to said communication management control unit at the predetermined cycle set for each data by said first communication function while the data receiving side thereof outputs said transmission request for communication data to said communication management control unit-at the predetermined cycle by said second communication function and receives the corresponding data from the communication management control unit.

* * * * *